US006503108B1

(12) United States Patent
Kikuchi et al.

(10) Patent No.: US 6,503,108 B1
(45) Date of Patent: Jan. 7, 2003

(54) GENERAL PURPOSE CONNECTOR AND CONNECTING METHOD THEREFOR

(75) Inventors: Kazuya Kikuchi, Tokyo (JP); Yoshihiro Kuroi, Tokyo (JP); Wataru Takahashi, Tokyo (JP)

(73) Assignee: NEC Tokin Corporation, Sendai (JP)

( * ) Notice: Subject to any disclaimer, the term of this patent is extended or adjusted under 35 U.S.C. 154(b) by 0 days.

(21) Appl. No.: 09/598,459

(22) Filed: Jun. 22, 2000

(30) Foreign Application Priority Data

Jun. 25, 1999 (JP) ..... 11-180942

(51) Int. Cl.[7] ..... H01R 13/64

(52) U.S. Cl. ..... 439/680; 439/608; 439/594; 439/701; 439/358

(58) Field of Search ..... 439/680, 681, 439/78, 701, 594, 717, 608, 358

(56) References Cited

U.S. PATENT DOCUMENTS

| | | | | | |
|---|---|---|---|---|---|
| 3,325,771 | A | * | 6/1967 | Ruehlemann et al. | 339/184 |
| 3,399,374 | A | * | 8/1968 | Pauza et al. | 174/138 F |
| 3,587,028 | A | * | 6/1971 | Uberbacher | 339/14 |
| 3,753,212 | A | | 8/1973 | Yamada et al. | |
| 4,506,940 | A | * | 3/1985 | Asick et al. | 439/290 |
| 4,693,531 | A | * | 9/1987 | Raphal et al. | 439/512 |
| 5,312,276 | A | * | 5/1994 | Hnatuck et al. | 439/681 |
| 5,613,881 | A | * | 3/1997 | Ichida et al. | 439/374 |
| 5,613,882 | A | * | 3/1997 | Hnatuck et al. | 439/372 |
| 5,643,014 | A | * | 7/1997 | Filus et al. | 439/680 |
| 5,664,856 | A | | 9/1997 | Pacetti | |
| 5,730,617 | A | * | 3/1998 | Araki et al. | 439/374 |
| 5,816,842 | A | * | 10/1998 | Thantrakul et al. | 439/374 |
| 5,865,651 | A | * | 2/1999 | Dague et al. | 439/218 |
| 5,902,155 | A | * | 5/1999 | Polgar et al. | 439/353 |
| 6,132,246 | A | * | 10/2000 | Kodama | 439/557 |
| 6,238,245 | B1 | * | 5/2001 | Stokoe et al. | 439/608 |
| 6,247,970 | B1 | * | 6/2001 | Ueno et al. | 439/108 |

FOREIGN PATENT DOCUMENTS

| | | |
|---|---|---|
| EP | 0 696 085 A2 | 2/1996 |
| FR | 2 734 089 A | 11/1996 |
| JP | 09 147960 A | 6/1997 |

OTHER PUBLICATIONS

European Search Report dated Feb. 22, 2002.

* cited by examiner

*Primary Examiner*—Tho D. Ta
*Assistant Examiner*—Edwin A. León
(74) *Attorney, Agent, or Firm*—McGinn & Gibb, PLLC

(57) ABSTRACT

The object of the present invention is to provide a general purpose connector with which development costs can be reduced and inventory can be easily controlled even when a plurality of terminal arrangements are required. In order to achieve this object, a general purpose connector according to the present invention includes: a connector housing-having a base including a terminal mounting portion; at least a pair of walls formed on the base; and a plurality of partitions being inserted into the connector housing, thereby forming a receiving space with the connector housing for receiving a mating connector, the receiving space being suitable for the terminal arrangement of the mating connector, wherein mis-insertion prevention groups are formed on the partitions to prevent either incorrect insertion as a result of receiving the wrong mating connector having the same terminal arrangement or reversed insertion as a result of receiving a corresponding mating connector in a reversed orientation.

24 Claims, 26 Drawing Sheets

GENERAL PURPOSE CONNECTOR AND CONNECTING METHOD THEREFOR

BACKGROUND OF THE INVENTION

1 Field of the Invention

This invention relates to a general purpose connector which can prevent mis-insertion of a mating connector and to a connecting method therefor.

2 Background Art

In general, a conventional connector has, for example, a base and fixed walls being connected to the base and surrounding a rectangular space, that rectangular space functions as a receiving space accepting a mating connector, so that the terminals located in the receiving space and the terminals of the mating connector are connected.

SUMMARY OF THE INVENTION

In the case of the conventional connector described above, the width of the receiving space i.e. arrangement of the terminals cannot be freely changed since the surrounding walls are fixed on the base, therefore, connectors must be respectively made corresponding to the arrangement of the terminals to be connected. As a result, many kinds of connectors each of which has a specific terminal arrangement must be constructed in order to achieve proper connections with each of the mating connectors with specific terminal arrangements, which leads to increased development costs and to complicated inventory control.

It is therefore an object of the present invention to provide a connector and a connecting method therefor with which development costs can be reduced, and inventory can be easily controlled, and with which it is easy to deal with mating terminals temporarily modified for the purpose of maintenance of or prototype stage for an apparatus having those connectors, even when a plurality of terminal arrangements are required.

In order to achieve the above object, a connector according to claim 1 in the present invention comprises a connector housing having a base including a terminal mounting portion and having at least a pair of walls formed on the base; and a plurality of partitions being inserted into the connector housing and thus forming receiving spaces, together with the connector housing for receiving mating connectors, being suitable for the terminal arrangement of the mating connector, wherein mis-insertion prevention means are formed on the partitions to prevent either incorrect insertion as a result of receiving the wrong mating connector having the same terminal arrangement or reversed insertion as a result of receiving a corresponding mating connector in a reversed orientation.

As described above, as a result of inserting the partitions into the connector housing, the connector housing and the partitions form the receiving spaces, for receiving the mating connectors, each of which is suitable for the terminal arrangement of a designated mating connector. Therefore, it is possible to provide a plurality of terminal arrangements each of which is suitable for a designated mating connector having a specific terminal arrangement simply by inserting the partitions in appropriate positions using the same connector housing. As a result, development costs can be reduced and inventory can be easily controlled even when a plurality of terminal arrangements are required. In addition, it is easy to deal with mating connectors temporarily modified for the purpose of maintenance of or prototype stage for an apparatus having those connectors.

Furthermore, due to the mis-insertion prevention means, either incorrect insertion as a result of receiving the wrong mating connector having the same terminal arrangement or reversed insertion as a result of receiving a corresponding mating connector in a reversed orientation can be prevented. The same connector housings can be used in a variety of applications since the mis-insertion prevention means are formed on the partitions. Thus, the prevention of mis-insertion is ensured. Development costs can be kept relatively low even with the mis-insertion prevention function. In addition, complicated inventory control can be avoided.

The general purpose connector according to claim 2 has a further feature in addition to those of the connector according to claim 1 in that a plurality of positioning guide means are formed at a constant pitch in said walls of said connector housing, and that said partitions are inserted into said connector housing while being guided by the corresponding positioning guide means.

By inserting the partitions into the connector housing while being guided by the corresponding positioning guide means which are formed at a constant pitch in the walls of the connector housing, the partitions and the connector housing form the receiving spaces, for receiving mating connectors, which are suitable for the terminal arrangement of each mating connector. It is possible to easily and accurately define the mounting position of the partitions relative to the connector housing.

The general purpose connector according to claim 3 has a further feature in addition to those of the connector according to claim 2 in that the positioning guide means are formed in the walls of the connector housing continuous from a position opposite to the base to the position of the base.

The partitions can be inserted into the connector housing in a stable manner since the positioning guide means are formed in the walls of the connector housing continuous from a position opposite to the base to the position of the base. As a result, workability during insertion of the partitions into the connector housing is improved, and shifting in the position of the partitions relative to the connector housing can be prevented reliably.

The general purpose connector according to claim 4 has a further feature in addition to those of the connector according to claim 2 in that the positioning guide means are located at an intermediate position between the two adjacent terminal mounting portions.

The interference between the partitions and the terminals can be avoided since the positioning guide means are located at an intermediate position between the two adjacent terminal mounting portions.

The general purpose connector according to claim 5 is a connector according to claim 1 further comprises cross partitions, wherein the cross partitions are fitted perpendicular to the partitions and thus form receiving space segments together with the connector housing.

The cross partitions, the partitions and the connector housing thus form the receiving space segments by fitting the cross partitions perpendicular to the partitions. The receiving space segments are arranged in both row and column directions. Therefore, it is possible to cope with a situation in which a plurality of terminal arrangements are required in both the row and the column directions.

The general purpose connector according to claim 6 has a further feature in addition to those of the connector according to claim 5 in that the partitions and the cross partitions have cross positioning guide means with which mutual positioning of the partitions and the cross partitions can be changed by regular intervals.

It is possible to easily and accurately define the mounting position of the partitions and the cross partitions since the partitions and the cross partitions have cross positioning guide means with which mutual positioning of the partitions and the cross partitions can be changed by regular intervals.

The general purpose connector according to claim 7 has a further feature in addition to those of the connector according to claim 1 in that the partitions have a pair of arms which respectively make contact with the outer surfaces of a pair of the walls of the connector housing, and that partition locking means are formed on the arms and on the walls of the connector housing in order to lock the partitions to the connector housing.

Deformation of the walls of the connector housing can be prevented since the partition has a pair of arms which respectively make contact with the outer surfaces of a pair of the walls of the. connector housing. Detachment of the partitions from the connector housing can be prevented since the partition locking means formed on the arms and on the walls of the connector housing lock the partitions to the connector housing. In addition, it is easy to release the locking since the partition locking means are formed on the arms and on the walls of the connector housing e.g. outside the connector housing. In this way, deformation of the connector housing is prevented, the mounting of the partitions in the connector housing is ensured and workability of releasing the locking is improved.

The general purpose connector according to claim 8 has a further feature in addition to those of the connector according to claim 1 in that the partitions and the connector housing has partition-reversed insertion prevention means which prevent the partitions from being inserted into the connector housing in a reversed orientation.

Due to the partition-reversed insertion prevention means, the insertion of the partitions reversed from their correct orientation is prevented. As a result, the mounting of the partitions in the connector housing in the proper orientation is ensured.

The general purpose connector according to claim 9 has a further feature in addition to those of the connector according to claim 1 in that the partitions have connector locking means which lock the mating connector being inserted into the receiving space to the partition.

The connector locking means lock the mating connector which is inserted into the receiving space, thus prevent detachment of the mating connector. The connector housing is not enlarged in a direction in which the walls are arranged because the connector locking means are formed not on the connector housing but on the partitions. The connection of the mating connector is thus ensured and enlargement of the connector housing in a direction in which the walls are arranged is avoided. As a result, it is possible to install, at high density and with small pitch, a plurality of connector housings in a direction in which the walls of the connector housing are arranged.

The general purpose connector according to claim 10 has a further feature in addition to those of the connector according to claim 1 in that terminals located in the terminal mounting portion are formed in a pin shape, and that the partitions have holes for receiving the terminals.

Based on this structure, the partitions can also be supported by the pin shaped terminals as a result of inserting the terminals arranged in the terminal mounting portion into the holes formed on the partitions. Thus, the mounting of the partitions in the connector housing is ensured, and shifting in the position of the partitions relative to the connector housing can be prevented reliably. In addition, the partitions can be mounted even when the terminal pitch is so small that partitions cannot be arranged in between the terminals.

The general purpose connector according to claim 11 has a further feature in addition to those of the connector according to claim 1 in that the connector housings can be connected to one another, and that the partitions and the connector housings have connecting means which connect the ends of the connector housings.

When mounting the partitions on the connecting housings arranged in series, the connecting means connect the connecting ends of the connector housings respectively. Thus, connection between the connector housings is ensured, and the walls are prevented from becoming weak due to having the connection area. In addition, since the partition also functions as a connecting member which connects the connector housings, the number of parts is limited compared with the case in which a separate member is provided to connect the connector housings.

The general purpose connector according to claim 12 has a further feature in addition to those of the connector according to claim 1 in that the partitions are made of metal, and that a shielding member made of metal is provided inside the connector housing.

Undesired electromagnetic waves, which are emitted by transmission of high frequency signals through signal-transmission lines, can be blocked by the partitions and the shielding member, so that an excellent shielding effect is achieved.

The method for connecting a general purpose connector according to claim 13 comprises the steps of providing a connector housing having a base and at least a pair of walls formed on the base, wherein a plurality of positioning guide means are formed at a constant pitch in the walls of the connector housing; inserting separated partitions into the connector housing with guidance by the corresponding positioning guide, means, and thereby forming receiving spaces, together with the connector housing for receiving mating connectors, each of which is suitable for the terminal arrangement of a designated mating connector; and preventing at least either incorrect insertion as a result of receiving the wrong mating connector having the same terminal arrangement or reversed insertion as a result of receiving a corresponding mating connector in a reversed orientation, by means of the particular shape of the partitions.

By means of inserting the partitions into the connector housing while being guided by the corresponding positioning guide means formed in the walls of the connector housing at a constant pitch, the receiving spaces are formed with the connector housing and the partitions for receiving mating connectors and are suitable for the terminal arrangement of each mating connector. Therefore, it is possible to provide a plurality of terminal arrangements each of which is suitable for a designated mating connector simply by inserting the partitions while being guided by the corresponding positioning guide means, even when a plurality of terminal arrangements are required to deal with different kinds of mating connectors. As a result, development costs can be reduced and inventory can be easily controlled even when a plurality of terminal arrangements are required. In addition, it is easy to deal with mating terminals temporarily modified for the purpose of maintenance of or prototype stage for an apparatus having those connectors.

In addition, due to the mis-insertion prevention means, either incorrect insertion as a result of receiving the wrong mating connector having the same terminal arrangement or reversed insertion as a result of receiving a corresponding mating connector in a reversed orientation can be prevented, thus the same connector housings can be used in a variety of applications. Therefore, development costs can be kept relatively low even with the addition of the mis-insertion prevention means and it is possible to avoid complicated inventory control.

DETAILED DESCRIPTION OF THE PREFERRED EMBODIMENTS

Referring to FIGS. 1 through 26B, the best mode of the general purpose connector according to the present invention will be explained hereinafter.

First Embodiment

A first embodiment of the present invention will be explained hereinafter with reference to FIGS. 1 through 8.

Figure 1:
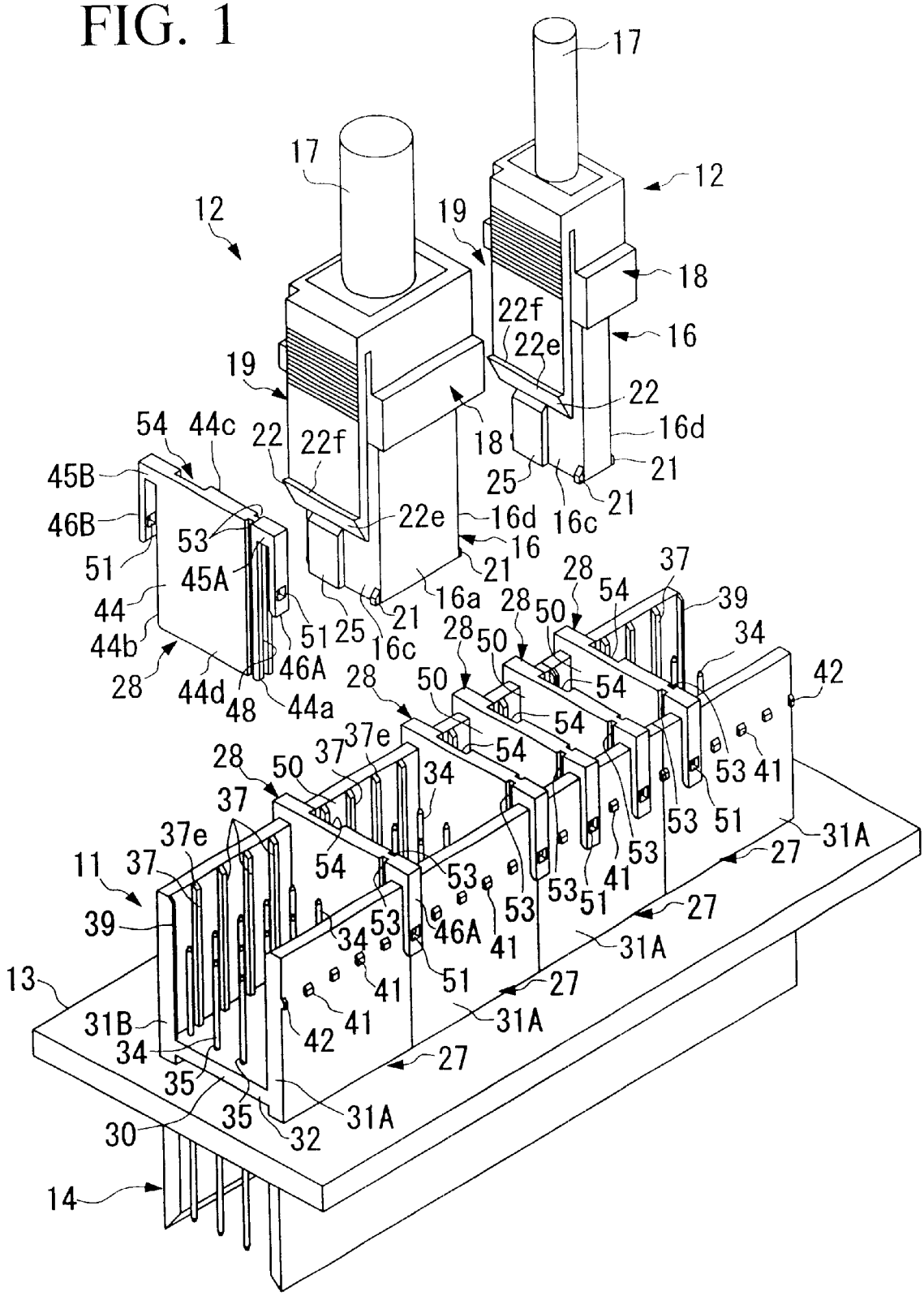
FIG. 1 is a perspective view showing a first embodiment of the general purpose connector according to the present invention.

FIG. 1 shows a male connector 11 as a first embodiment of the present invention, a plurality of female connectors 12 as mating connectors detachably connectable to the male connector 11, a printed circuit board 13 and a foreside male connector 14 disposed on the side opposite to the male connector 11.

First of all, the female connector 12 is explained. The female connector 12 comprises an insertion portion 16 formed substantially in the shape of a cuboid, female terminals (not shown) disposed inside the leading end of the insertion portion 16 in a specific arrangement, a support part 18 formed at the base of the insertion portion 16 and holding a corresponding cable 17, and an elastic connector lock 19 extending from the support part 18 to the insertion portion 16 while forming a gap and parallel with the insertion portion 16. Reversed-insertion prevention projections 21 extend from one side face and along this side face which is perpendicular to the elastic connector lock 19 in more detail, these reversed-insertion prevention projections 21 are substantially cuboid projecting from a pair of side faces 16*c* and 16*d* being parallel with the elastic connector lock 19.

Those reversed-insertion prevention projections 21 are formed in order to prevent the female connector 12 from being inserted into the receiving space 50 of the male connector 11 in a reversed orientation, and work in co-operation with the male connector 11 (explained below).

Figure 6:
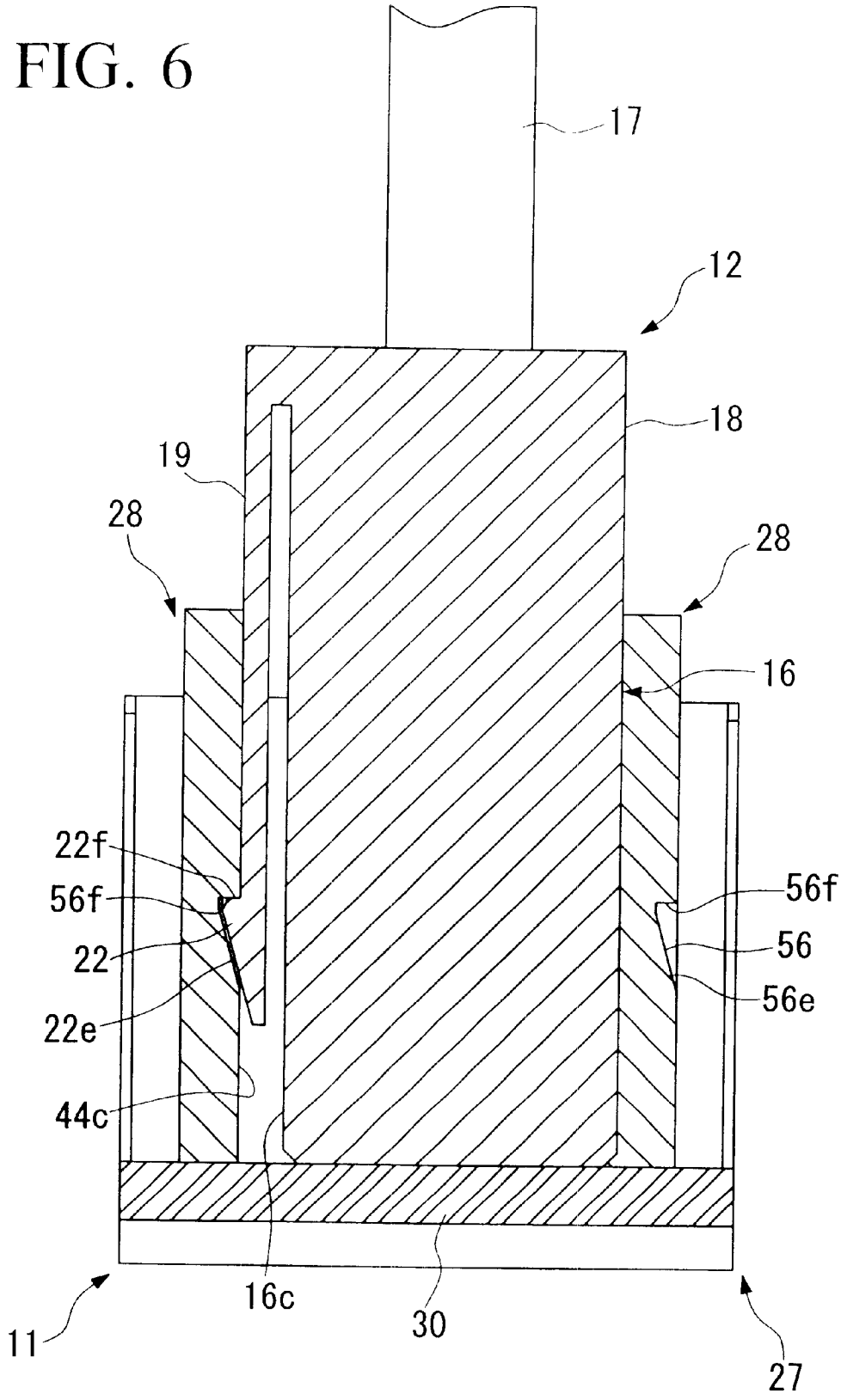
FIG. 6 is a cross-sectional view showing a female connector connected to the first embodiment of the general purpose connector according to the present invention.

As shown in FIGS. 1 and 6, a connector locking projection 22 is formed at the end of the elastic connector lock 19 opposing the insertion portion 16. The connector locking projection 22 has an inclined face 22*e* which inclines so as to be more distant from the insertion portion 16 as it extends toward the support part 18 (upward in FIGS. 1 and 6). A stop face 22*f* being perpendicular to the extending direction of the insertion portion 16 is formed from the inclined face 22*e* toward the support part 18.

A key-shaped mis-insertion prevention projection 25 is detachably attached to the side face 16*c* of the insertion portion 16 of the female connector 12, the side face 16*c* is on the same side as the elastic connector lock 19. The mis-insertion prevention projection 25 is disposed in order to prevent incorrect insertion wherein a female connector 12 having non-matching signal-transmission lines and matching terminal arrangement is inserted into the receiving space 50 of the male connector 11, and also to prevent reversed insertion wherein a corresponding female connector 12 having matching signal-transmission lines is inserted into the receiving space 50 of the male connector 11, as a result of co-operation with the male connector 11 (explained below).

If a plurality of female connectors 12 have the same terminal arrangement, the mis-insertion prevention projections 25 each of which is different from the others at least in either mounting position or shape are attached to the corresponding female connectors 12, respectively. For example, if six female connectors 12 have the same terminal arrangement, six kinds of mis-insertion prevention projections 25 being different from each other at least in either mounting position or shape are attached to the corresponding female connectors 12, respectively. As will be described later, each receiving space 50 in the male connector 12 is formed so that it accepts only the mis-insertion prevention projection 25 of the female connector 12 having the corresponding signal-transmission lines. All the female connectors 12 having the same terminal arrangement are formed in the same shape and in the same size as each other except for the mis-insertion prevention projections 25.

The male connector 11 has a plurality of connector housings 27 and a plurality of partitions 28. All of the connector housings 27 have the same shape. Each connector housing 27 is made by injection molding of a synthetic resin or the like, and comprises a rectangular base plate (a base) 30, a pair of rectangular wall plates (the walls) 31A and 31B being parallel to each other and extending perpendicularly to the base plate 30 from the parallel edges of the base plate 30. No wall plates extend from the pair of ends 32 of the base plate 30 which are perpendicular to the wall plates 31A and 31B. These connector housings 27 are used being disposed in line so that the adjacent ends 32 contact each other.

Figure 2:
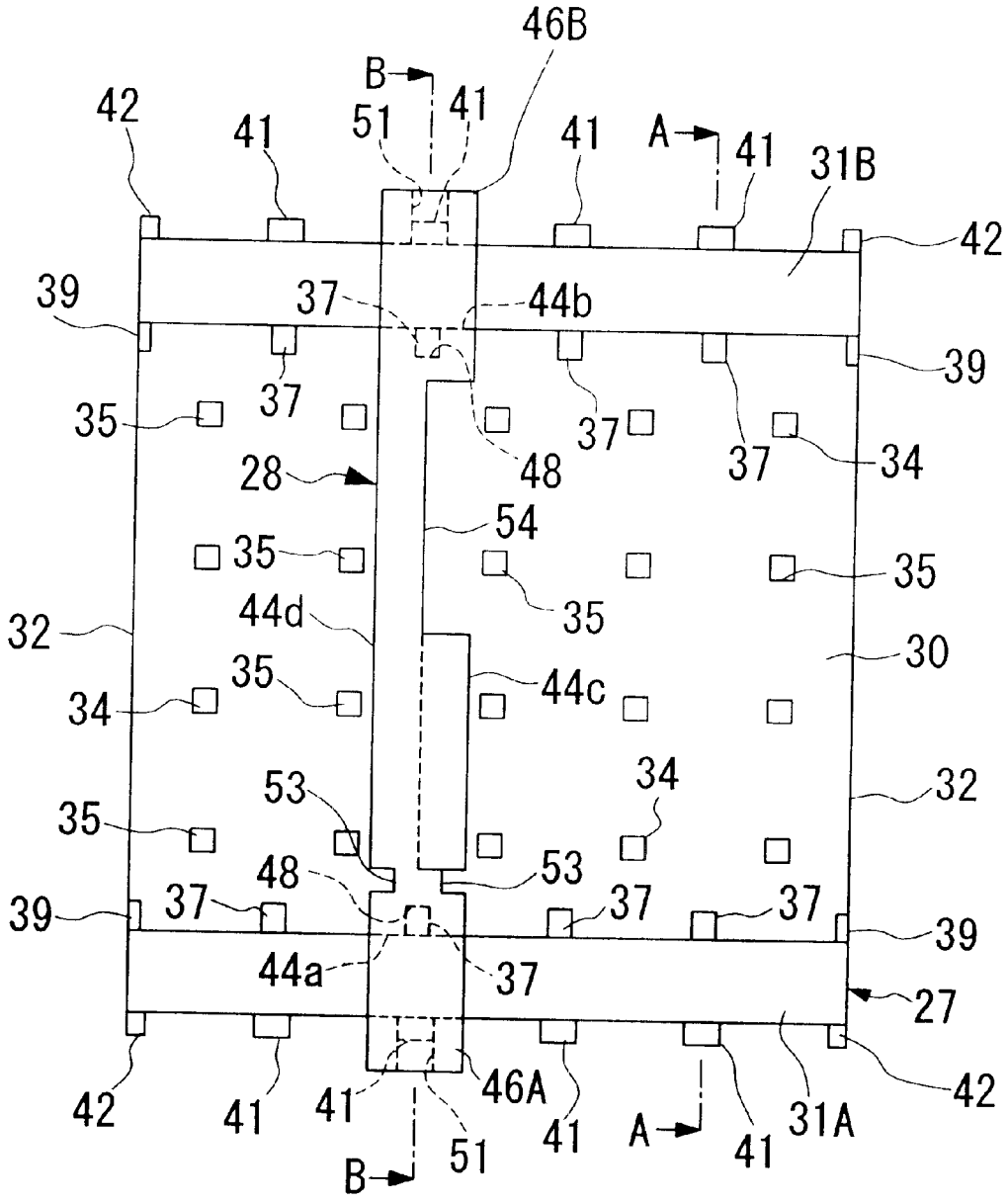
FIG. 2 is a plan view showing the connector housing and the partition of the first embodiment of the general purpose connector according to the present invention.

As shown in FIG. 2, a number of terminal holes (terminal mounting portions) 35 are formed in the base plate 30 so that those holes penetrate the thickness of the base plate 30 in order to position post pins 34 as the male terminals. All of the terminal holes 35 are formed in the same shape and in the same size as each other. These terminal holes 35 are formed at the intersectional points of two kinds of imaginary lines (not shown), one type being along a direction in which the wall plates 31A and 31B extend (to be called the row direction hereinafter) on the base plate 30 and having a constant pitch in a direction in which the wall plates 31A and 31B are arranged (to be called the column direction hereinafter) on the base plate 30, and the other type being along the column direction on the base plate 30 and having a constant pitch in the row direction on the base plate 30.

To this end, the imaginary lines disposed in the row direction and the others disposed in the column direction have the same constant pitch. The distance between the imaginary line being closest to the wall plate 31A and the wall plate 31A is equal to the distance between the imaginary line being closest to the wall plate 31B and the wall plate 31B, and that distance is equal to about a half of the constant pitch of the imaginary lines. In addition, the distance between the imaginary line being closest to one end 32 and the end 32 is equal to the distance between the imaginary line being closest to the other end 32 and the end 32, and that distance is equal to about a half of the constant pitch of the imaginary lines. As a result, the constant pitch is kept between the terminal holes belonging to two adjacent connector housings disposed in line.

The post pins 34 are respectively attached to those terminal holes 35 disposed in the above-mentioned way. As shown in FIG. 1, each post pin 34 is attached penetrating the connector housing 27 of the male connector 11, the printed circuit board 13 and the foreside male connector 14. In this way, the male connector 11 is fixed to the printed circuit board 13 by means of the post pins 34.

A plurality of positioning guide ribs (positioning guide means) 37 are formed in the wall plates 31A and 31B and inside the wall plates 31A and 31B in the column direction (i.e. facing the other wall plate) at a constant pitch in the row direction. More specifically, the positioning guide ribs 37 are disposed at the intermediate points of the aforementioned imaginary lines in the row direction.

All of the positioning guide ribs 37 are formed in the same shape and in the same size as each other, perpendicularly and constantly extend from the base plate 30 to the other ends of the wall plates 31A and 31B. A chamfer 37*e*, inclining toward the base plate 30 as it extends further inside the connector housing 27, is formed on each guide rib 37 at the end being opposite to the base plate 30.

Figure 4:
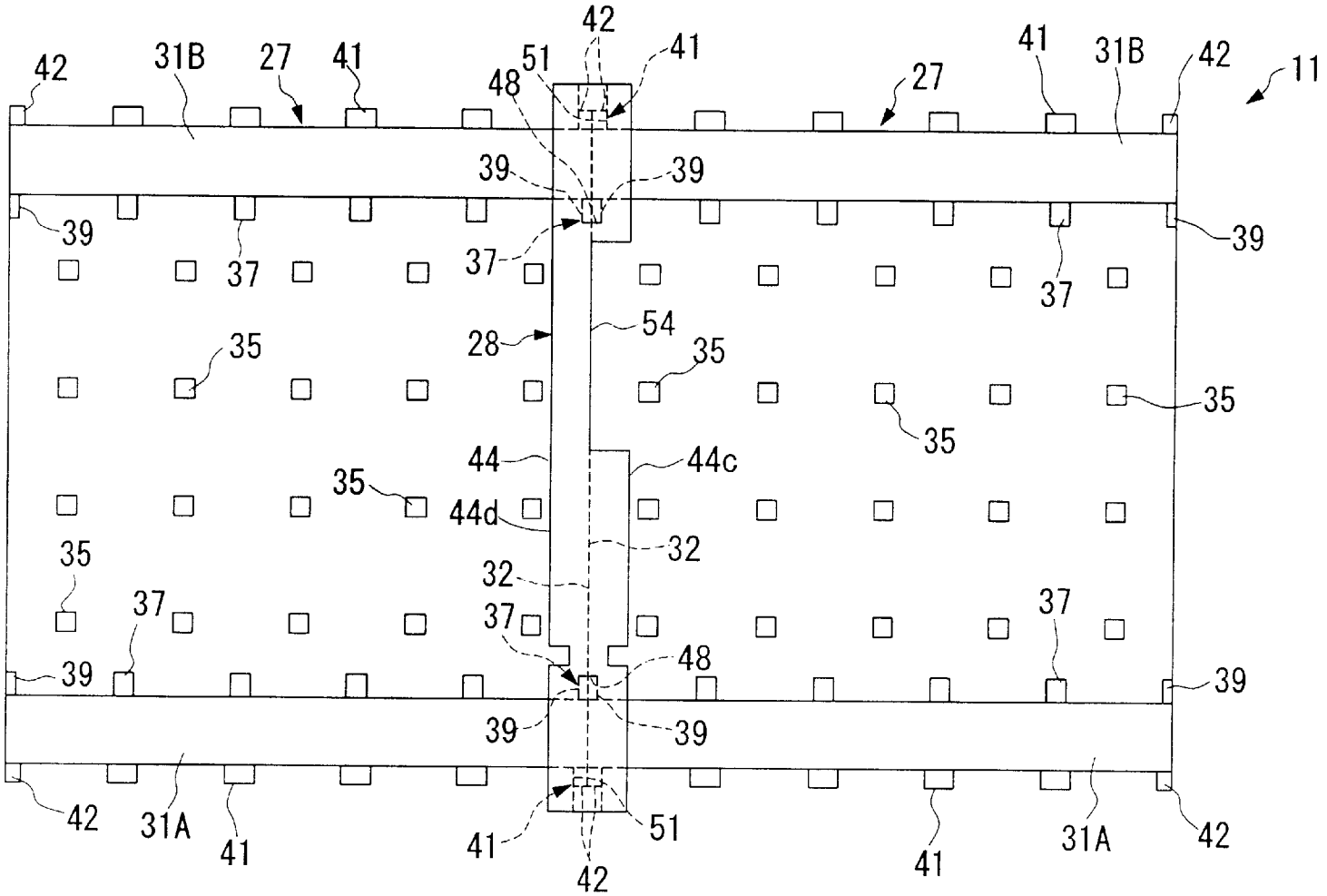
FIG. 4 is a plan view showing the connector housings and the partition of the first embodiment of the general purpose connector according to the present invention, wherein the partition is mounted at the connecting areas of the connector housings.

Half guide ribs 39 are formed on the ends 32 of the wall plates 31A and 31B inside the connector housing 27. The half guide rib 39 has a half width in the row direction compared with the guide rib 37 mentioned above and composes a complete positioning guide rib 37 with the adjacent half guide rib 39 formed on the adjacent connector housing 27, as shown in FIG. 4.

Partition locking projections 41 are formed on the outside surface of the wall plates 31A and 31B (i.e. opposite the other wall plate) at a constant pitch in the row direction. More specifically, the partition locking projections 41 are formed on the same rows on which the positioning guide ribs 37 exist.

Figure 3A:
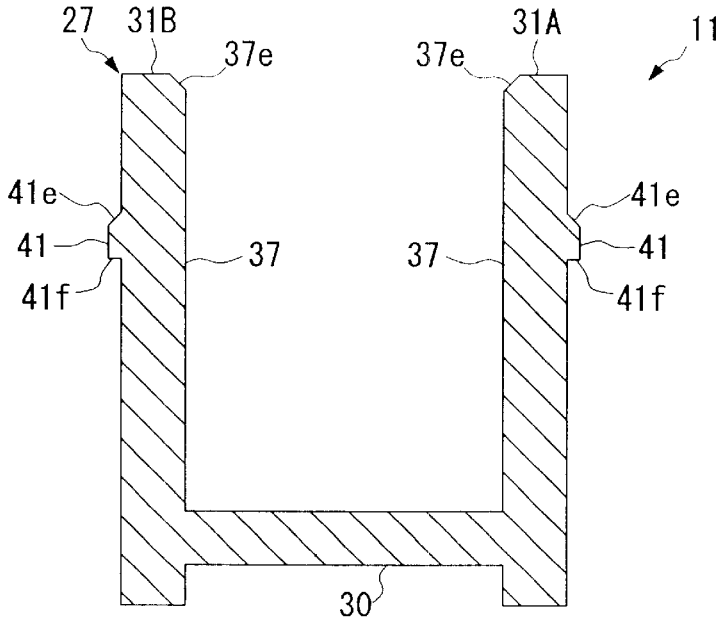
FIG. 3A is a cross-sectional view of the connector housing of FIG. 2 taken along the line A—A.
Figure 3B:
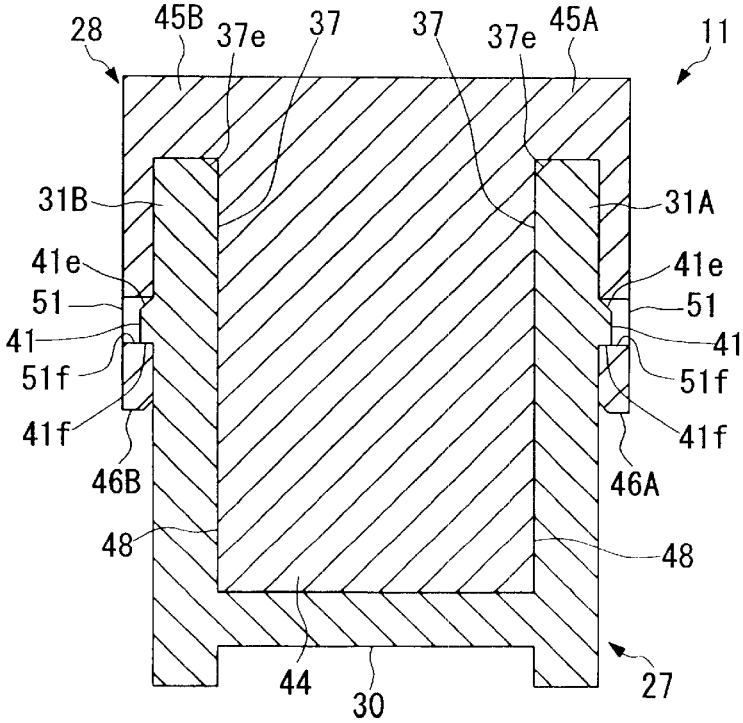
FIG. 3B is a cross-sectional view of the connector housing and the partition of FIG. 2 taken along the line B—B.

As shown FIGS. 1, 3A and 3B, all of the partition locking projections 41 are formed in the same shape and in the same size as each other, and having a certain distance from the base plate 30. More specifically, those partition locking projections 41 are substantially cuboid, and a chamfer 41*e*, inclining toward the base plate 30 as it extends further outside the connector housing 27, is formed on each partition locking projections 41 at the end being opposite to the base plate 30. A stop face 41*f*, being parallel to the base plate 30, is formed on each partition locking projection 41 at the end being opposite to the chamfer 41*e*.

Half locking projections 42 are formed on the ends 32 of the wall plates 31A and 31B outside the connector housing 27. Each half locking projection 42 has a width in the row direction which is half that of the partition locking projection 41 mentioned above and forms a complete partition locking projection 41 with the adjacent half locking projection 42 formed on the adjacent connector housing 27, as shown in FIG. 4.

The partition 28 is made by injection molding of a synthetic resin or the like, and is inserted into the connector housing 27, and thereby makes segments arranged in the row direction in the connector housing 27. The partition 28 comprises a partitioning plate 44 shaped rectangular and being inserted between a pair of the wall plates 31A and 31B of the connector housing 27, a pair of projecting parts 45A and 45B projecting outwardly from the top end of the partitioning plate 44, and a pair of arms 46A and 46B extending from the outermost ends of the projecting parts 45A and 45B, downwardly and parallel with the side edges of the partitioning plate 44 so as to be in contact with the outer surface of the pair of the wall plates 31A and 31B of the connector housing 27.

The width of the partitioning plate 44 is approximately the same as the distance between the wall plates 31A and 31B of the connector housing 27, and the length of the part of the partitioning plate 44 excluding the projecting parts 45A and 45B is approximately the same as the height of the wall plates 31A and 31B of the connector housing 27. In addition, the gap between the partitioning plate 44 and the arms 46A and 46B i.e. the length of the projecting parts 45A and 45B is approximately the same as the thickness of the wall plates 31A and 31B excluding the positioning guide rib 37 and the partition locking projection 41.

Figure 5:
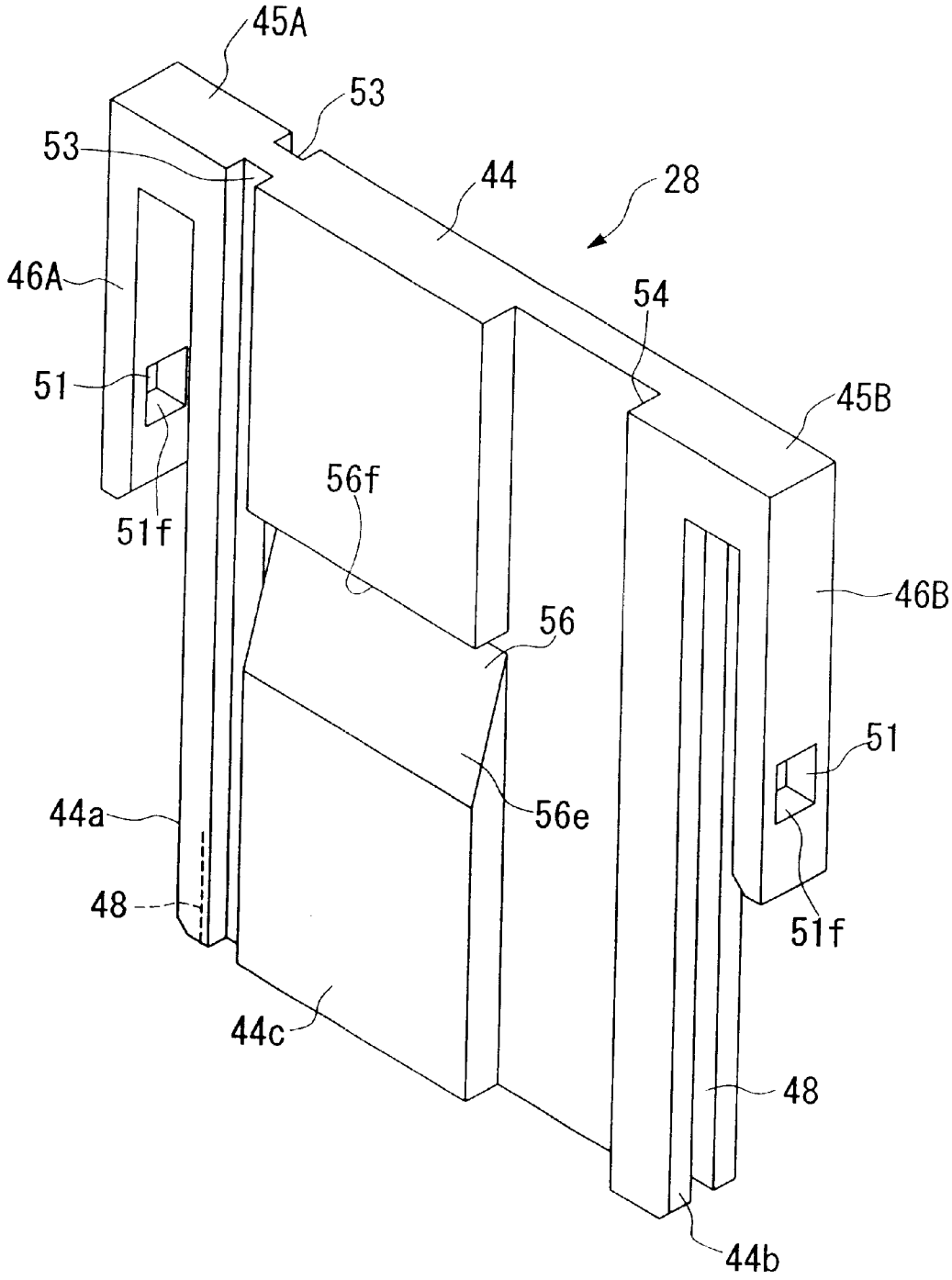
FIG. 5 is a perspective view showing the partition of the first embodiment of the general purpose connector according to the present invention.

As shown in FIGS. 2 and 5, positioning guide grooves 48 are formed along the center of the sides 44*a* and 44*b* facing the arms 46A and 46B of the partitioning plate 44. Both of the positioning guide grooves 48 are formed on the sides 44*a* and 44*b* along the direction in which the sides 44*a* and 44*b* extend, continuous from the position of the projecting parts 45A and 45B to a position opposite to the projecting parts 45A and 45B, and are formed in the same shape and in the same size as each other so as to match the positioning guide rib 37, so that either of the positioning guide ribs 37 can be slid into the guide groove 48.

The partitions 28 are inserted into the connector housing 27 perpendicularly to the wall plates 31A and 31B by respectively engaging the positioning guide grooves 48 in the corresponding positioning guide ribs 37 (located on the same row) of the wall plates 31A and 31B of the connector housing 27 and with guidance by means of the positioning guide ribs 37.

As a result, the partition 28 together with another partition 28 and the connector housing 27 form the receiving space 50, which matches the terminal arrangement of the female connector 12 and accepts the female connector 12 having corresponding signal-transmission lines. For example, if the corresponding female connector 12 has female terminals arranged in a 4 by 2 (4 rows by 2 columns) arrangement, the partition 28 is engaged with the second adjacent positioning guide rib 37 relative to the positioning guide rib 37 having received another partition 28 so that the post pins 34 are arranged in a 4 by 2 arrangement between this partition 28 and the other partition 28.

The positioning guide rib 37 of the connector housing 27 is located at an intermediate position (at the middle position, more specifically) between the adjacent terminal holes 35 in the row direction, as a result of which the partition 28, engaged with the connector housing 27 with engagement of the positioning guide rib 37 and the positioning guide groove 48, is located without interference with the terminal holes 35 or the post pins 34 positioned therein.

As shown in FIGS. 3A and 3B, partition locking recesses 51 having a rectangular cross-section, extending along the width of the partitioning plate 44 and penetrating the arms 46A and 46B, are formed at a certain position on the arms 46A and 46B. When the partitioning plate 44 is inserted between the wall plates 31A and 31B of the connector housing 27, the arms 46A and 46B slide along the respective outer surfaces of the wall plates 31A and 31B, elastically deform in the direction away from the partitioning plate 44 onto the partition locking projection 41 so that the tips of the arms 46A and 46B are guided by the chamfer 41*e* of the partition locking projection 41, and then return to their original shape and contact the respective wall plates 31A and 31B when the partition locking recesses 51 move to the position of the partition locking projections 41. The partition locking recesses 51 accommodate the partition locking projections 41.

At this stage, the partition 28 is prevented from becoming detached from the connector housing since the stop faces 51*f*, disposed opposite the projecting parts 45A and 45B in the partition locking recesses 51, and the stop faces 41*f*, disposed opposite the chamfers 41*e* on the partition locking projections 41, oppose and make contact with each other.

As described above, the partition locking recesses 51 of the arms 46A and 46B of the partition 28 and the partition locking projections 41 of the wall plates 46A and 46B of the connector housing 27 compose the partition locking means which lock the partition 28 to the connector housing 27.

As shown in FIG. 4, the movement of a pair of half guide ribs 39 in a direction away from each other (in the row direction) is restricted as a result of the engagement of the positioning guide rib 37, consisting of a pair of half guide ribs 39, with the positioning guide groove 48. At the same time, the movement of a pair of half locking projections 42 in the direction away from each other (in the row direction) is also restricted as a result of the engagement of the partition locking projection 41, consisting of a pair of half locking projections 42, with the partition locking recess 48. Thus, the connector housings 27 are connected with each other at the ends.

As described above, the positioning guide groove 48 and partition locking recess 51 of the partition 28, and the half guide ribs 39 and the half locking projections 42 of the connector housing 27 compose the connecting means which connect the connector housings 27 with each other at the ends.

With regard to the partitioning plate 44, reversed-insertion prevention guide grooves 53 (mis-insertion prevention means) are formed on both main surfaces 44*c* and 44*d*. Both of the reversed-insertion prevention guide grooves 53 are located near, in the lateral direction, the arm 46A, and extend along the length of the partitioning plate 44 over the entire length.

These reversed-insertion prevention guide grooves 53 are formed in order to prevent a corresponding female connector 12 having a matching terminal arrangement from being inserted in a reversed orientation, and work in co-operation with the reversed-insertion prevention projection 21 formed on the female connector 12. These reversed-insertion prevention guide grooves 53 are formed in the same shape as each other so that any of the reversed-insertion prevention projections 21 can be fitted in.

As shown in FIG. 1, all of the reversed-insertion prevention guide grooves 53 are located near the wall plate 31A of the connector housing 27 when all of the partitions 28 are inserted into the connector housing 27. In this state, a female connector 12 not being disposed in the correct orientation such that the reversed-insertion prevention projections 21 fit in the reversed-insertion prevention guide grooves 53 (in other words, in a reversed orientation such that the reversed-insertion prevention projections 21 are positioned away from the reversed-insertion prevention guide grooves 53) cannot be inserted into the receiving space 50 of the male connector 11 because the reversed-insertion prevention projections 21 interfere with the partitions 28.

As shown in FIG. 5, a mis-insertion prevention guide groove 54 (mis-insertion prevention means) is formed on one surface 44*c* of the partitioning plate 44. The mis-insertion prevention guide groove 54 is formed along the length of the partitioning plate 44 over the entire length.

The mis-insertion prevention guide groove 54 works in co-operation with the shape of the female connector 12 and prevents both incorrect insertion wherein the wrong female connector 12 having matching terminal arrangement is inserted, and reversed insertion wherein the corresponding female connector 12 is inserted in a reversed orientation.

As shown in FIG. 1, the mis-insertion prevention guide grooves 54 are disposed on the same side of the partitions 28 in view of the arrangement direction of the connector housings 27 (drawn facing toward top right hand corner of the page in FIG. 1) when the partitions 28 are inserted into the connector housings 27, and thus prevent the female connector 12 from being mis-inserted into the receiving spaces 50 having the mis-insertion prevention guide groove 54. When the male connector 11 has a plurality of the receiving spaces 50 each having the same terminal arrangement, the partition 28, having the mis-insertion prevention guide groove 54 differentiated from others in at least either position or shape, is inserted into the connector housing 27 to define the corresponding receiving space 50.

In this way, each receiving space 50 is provided with a mis-insertion prevention guide groove 54 which is different from the others. On the other hand, the female connector 12 is provided with the mis-insertion prevention projection 25 which can be fitted in the mis-insertion prevention guide groove 54 formed in the receiving space 50 corresponding to the female connector 12 for signal transmission. As a result, only the corresponding female connector 12 can be inserted into the receiving space 50. All of the partitions 28 have the same shape and the same size except for the mis-insertion prevention guide grooves 54.

For example, if there are six female connectors 12 having the same terminal arrangement, six kinds of mis-insertion prevention guide grooves 54 each of which is differentiated from others in at least either position or shape are formed on the respective partitions 28, as shown in FIGS. 7A through 7F, and those partitions 28 are inserted into the connector housings 27 so that the mis-insertion prevention guide grooves 54 are disposed in the same side in view of the arrangement direction of the connector housings 27.

Figure 7A:
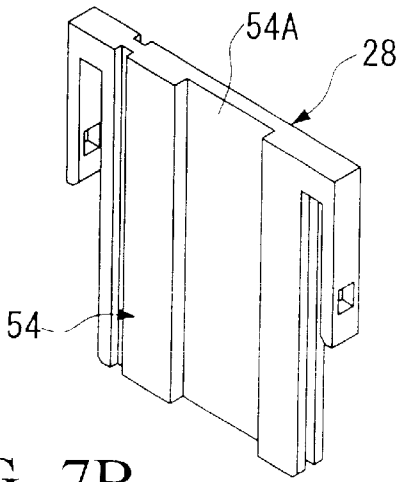
FIGS. 7A through 7F are perspective views showing various kinds of the mis-insertion prevention grooves formed on the partitions of the first embodiment of the general purpose connector according to the present invention.
Figure 7B:
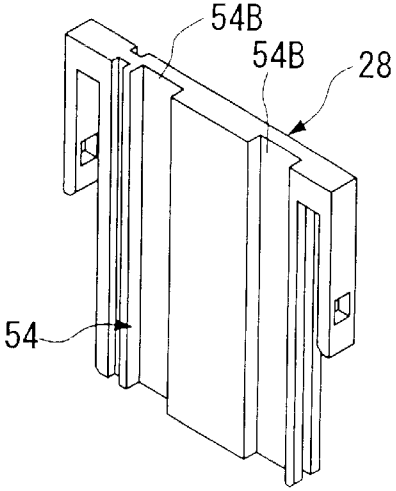
Figure 7C:
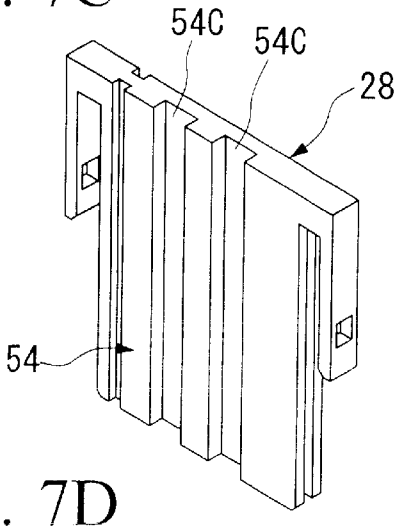
Figure 7D:
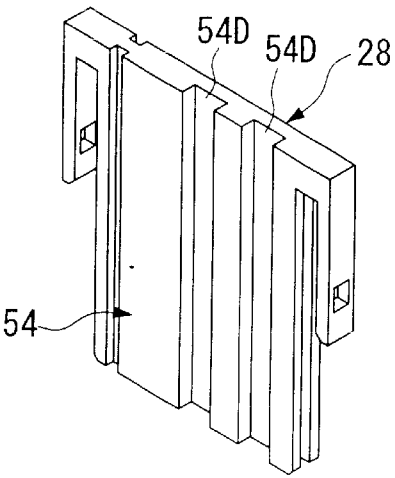
Figure 7E:
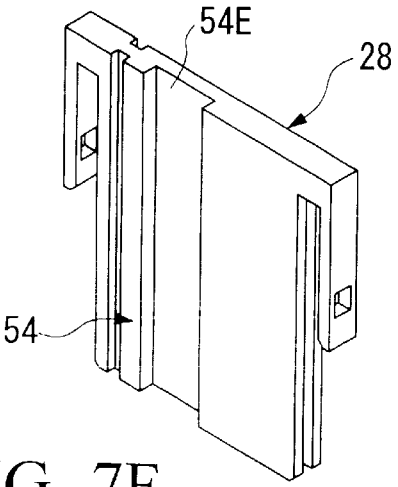
Figure 7F:
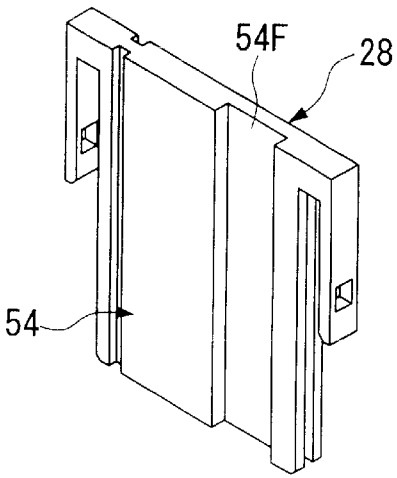

More specifically, the partition 28 shown in FIG. 7A has a groove 54A with the same width as the mis-insertion prevention guide groove 54, and the partition 28 shown in FIG. 7B is provided with two grooves 54B as the mis-insertion prevention guide groove 54 both of which are narrower than the groove 54A and are positioned differently from the groove 54A. The partition 28 shown in FIG. 7C is provided with two grooves 54C as the mis-insertion prevention guide grooves 54 both of which are narrower than the grooves 54A and 54B and are positioned differently from the grooves 54A and 54B. The partition 28 shown in FIG. 7D is provided with two grooves 54D as the mis-insertion prevention guide grooves 54 both of which have the same width as that of the groove 54C and are positioned differently from the grooves 54C. The partition 28 shown in FIG. 7E is provided with a groove 54E as the mis-insertion prevention guide groove 54 which is narrower than the groove 54A and wider than the groove 54B. The partition 28 shown in FIG. 7F is provided with a groove 54F as the mis-insertion prevention guide groove 54 which has the same width as that of the groove 54E and are positioned differently from the groove 54E.

The mis-insertion prevention guide grooves 54 are provided on only one side of the partitions 28, after the partitions 28 are inserted into the connector housings 27, in order to dispose the mis-insertion prevention guide grooves 54 on a predetermined side in view of a direction in which the connector housings 27 are arranged. Thus, the operator can see all of the mis-insertion prevention guide grooves 54 from one direction, and then reversed insertion of the female connectors 12 can be prevented.

As described before, a incorrect insertion wherein the wrong female connector 12 having non-matching signal-transmission lines and matching terminal arrangement is inserted into the receiving space 50 of the male connector 11 can be prevented by comparing the mis-insertion prevention projection 25 of the female connector 12 with the mis-insertion prevention guide groove 54 provided in the receiving space 50 of the male connector 11.

The mis-insertion prevention guide groove 54, working in cooperation with the mis-insertion prevention projection 25 of the female connector 12, prevents a corresponding female connector 12, having matching signal-transmission lines and matching terminal arrangement, from being inserted in a reversed orientation, since the mis-insertion prevention guide grooves 54 are provided on only one side of the partitions 28 in view of the arrangement direction of the connector housings 27 after the partitions 28 are inserted into the connector housings 27.

In the receiving spaces 50 of the male connector 11, the mis-insertion prevention guide grooves 54 are provided on only one side in view of the arrangement direction of the connector housings 27. As a result, a female connector 12 held in a reversed orientation, in which the mis-insertion prevention projection 25 of the female connector 12 faces not the partition surface with a mis-insertion prevention guide groove 54 but the adjacent partition surface without a mis-insertion prevention, guide groove 54, cannot be inserted into the receiving space 50 of the male connector 11, because the mis-insertion prevention projection 25 interferes with the partition 28.

As shown in FIGS. 5 and 6, a groove-shaped connector locking recess 56 (connector locking means) is formed in the surface 44*c* with the mis-insertion prevention groove 54 of the partitioning plate 44, at an intermediate position in the length of the partitioning plate 44. This connector locking recess 56 has a shape matching the connector locking projection 22 of the female connector 12 which is to be inserted into the receiving space 50 and locks the female connector 12 by engagement. More specifically, the connector locking recess 56 comprises inclined surface 56*e* which inclines so that the depth is deeper approaching the projecting parts 45A and 45B, and a stop face 56*f* perpendicular to the extending plane of the partitioning plate 44.

Based on the construction described above, when the female connector 12 is inserted into the corresponding receiving space 50 of the male connector 11 with the elastic connector lock 19 facing the connector locking recess 56 of the partition 28, the elastic connector lock 19 elastically deforms toward the insertion portion 16 as a result of being pushed by the partition 28 at the connector locking projection 22. As the insertion progresses further, the connector locking projection 22 as a whole reaches the position of the connector locking recess 56 then enters into it helped with elastic force. At this moment, the stop face 22*f* of the connector locking projection 22 and the stop face 56*f* of the connector locking recess 56 oppose and come into contact with each other, as shown in FIG. 6, thus the female connector 12 is locked in the male connector 11 by the engagement of the stop faces 22*f* and 56*f*.

On the other hand, after having this locking state, if the elastic connector lock 19 is pressed at a part located outside the male connector 11 and is elastically deformed toward the insertion portion 16, the stop faces 22*f* and 56*f* are released from their opposing position and then it is possible to pull the female connector 12 out of the male connector 11.

In the first embodiment described hereinbefore, the connector housings 27 are mounted on the printed circuit board 13 having the post pins 34 by means of insertion of the post pins 34 into the terminal holes 35. The connector housings 27 are arranged in series so that the ends 32 without walls, the wall plates 31A and the wall plates 31B respectively make contact with each other.

Then the appropriate partitions 28 are inserted into the connector housings 27 at appropriate positions. More specifically, a partition 28 having a required mis-insertion prevention guide groove 54 is inserted into the connector housing 27 while being guided by the positioning guide groove 48 and the positioning guide rib 37 which is inserted into the former. As the insertion progresses, the arms 46A and 46B of the partition 28 slide on the outer surfaces of the corresponding wall plates 31A and 31B, then are pressed by the partition locking projections 41 and are elastically deformed. By further insertion, the partition locking projections 41 engage the partition locking recesses 51, and the arms 46A and 46B return to their original state. The mounting of the partition 28 is completed at this point. In this state, the partitioning plate 44 makes contact with the base plate 30, and projecting parts 45A and 45B make contact with the wall plates 31A and 31B respectively.

Having all of the partitions 28 being mounted at predetermined positions, the male connector 11 with a plurality of receiving spaces 50 is formed. As described before, each receiving space 50 has a reversed-insertion prevention guide groove 53 and a mis-insertion prevention guide groove 54 respectively. The receiving space 50 may have a partition 28 having only a reversed-insertion prevention guide groove 53 and not having a mis-insertion prevention guide groove 54 if there are no other receiving spaces 50 which have the same terminal arrangement, because there is no risk of incorrect insertion. On the other hand, mis-insertion prevention projections 25 are provided on the side faces 16*c* of the insertion portion 16.

The female connector 12 thus formed is inserted into the corresponding receiving space 50 of the male connector 11. More specifically, the insertion portion 16 of the female connector 12 is inserted into the receiving space 50 of the male connector as the mis-insertion prevention projection 25 is fitted into the mis-insertion prevention guide groove 54 and the reversed-insertion prevention projection 21 is fitted into the reversed-insertion prevention guide groove 53.

As the insertion progresses, the elastic connector lock 19 elastically deforms and enters into the receiving space 50 so that the inclined face 22*e* of the connector locking projection 22 is pressed by the partition 28. By further insertion, the connector locking projection 22 engages the connector locking recess 56, thus the female connector 12 is locked in the male connector 11. In this state, the female terminals can communicate with the post pins 34 located in the receiving space 50 of the male connector 11.

On the other hand, a female connector 12, having a matching terminal arrangement and non-matching signal-transmission lines for a receiving space 50, is prevented from being mis-inserted into the receiving space 50 since the mis-insertion prevention projection 25 of the female connector 12 interferes with the mis-insertion prevention guide groove 54 located in the receiving space 50 due to a shape difference or a position difference. Mis-insertion of a female connector 12 having non-matching terminal arrangement into a receiving space 50 is of course prevented because the female connector 12 as a whole cannot be inserted into the receiving space 50 and the misplacement of the female connector 12 can be clearly recognized, regardless of the existence of a mis-insertion prevention projection 25.

Furthermore, reversed insertion of a female connector 12 into a receiving space 50 having the corresponding signal-transmission lines is also prevented because the insertion of the mis-insertion prevention projection 25 of the female connector 12 into the receiving space 50 is interfered with by the partition 28 and the insertion of the reversed-insertion prevention projection 21 into the receiving space 50 is interfered with by the partition 28.

In the first embodiment described above, by inserting the partitions 28 into the connector housing 27 while being guided by the corresponding positioning guide ribs 37, which are formed at a constant pitch in the wall plates 31A and 31B of the connector housing 27, and the positioning guide grooves 48 of the partitions 28, the connector housing 27 and the partitions 28 form the receiving space 50, for receiving a female connector 12, which is suitable for the terminal arrangement of the female connector 12. Therefore, it is possible to provide a plurality of terminal arrangements being suitable for female connectors 12 having differing terminal arrangements, only by inserting the partitions 28 into appropriate positions being guided by the corresponding positioning guide ribs 37 with the same connector housings 27. As a result, development costs can be reduced and inventory can be easily controlled even when a plurality of terminal arrangements are required. In addition, it is easy to deal with mating connectors temporarily modified for the purpose of maintenance of or prototype stage for an apparatus having those male connectors 11, by means of interchanging of the partitions 28.

It is possible to easily and accurately define the mounting position of the partitions relative to the connector housing since the partitions 28 are inserted into the connector housing 27 while being guided by the corresponding positioning guide ribs 37, which are formed at a constant pitch in the wall plates 31A and 31B of the connector housing 27, and by the positioning guide grooves 48 of the partitions 28.

Furthermore, due to the mis-insertion prevention guide groove 54 and the reversed-insertion prevention guide groove 53, both incorrect insertion as a result of receiving the wrong female connector 12 having the same terminal arrangement and reversed insertion as a result of receiving a corresponding female connector 12 in a reversed orientation can be prevented. The interference area with the female connector 12 for preventing the mis-insertion can be relatively large and the same connector housings 27 can be used for a variety of applications, since the mis-insertion prevention guide groove 54 and the reversed-insertion prevention guide groove 53 are formed on the partitions 28. Thus, the prevention of mis-insertion is ensured. Development costs can be kept relatively low even with the addition of the mis-insertion prevention function, and it is possible to avoid complicated inventory control.

Deformation of the wall plates 31A and 31B of the connector housing 27 can be prevented since the partition 28 has a pair of arms 46A and 46B which respectively make contact with the outer surfaces of a pair of the wall plates 31A and 31B of the connector housing 27. Detachment of the partitions 28 from the connector housing 27 can be prevented since the partition locking grooves 51 and the partition locking projections 41 lock the partitions 28 to the connector housing 27. In addition, it is easy to release the locking since the partition locking grooves 51 are formed on the arms 46A and 46B of the partition 28 and the partition locking projections 41 are formed in the wall plates 31A and 31B of the connector housing 27 e.g. outside the connector housing 27. In this way, deformation of the connector housing 27 is prevented, the mounting of the partitions 28 in the connector housing 27 is ensured and also workability for releasing the locking is improved.

The partition 28 can be inserted into the connector housing 27 in a stable manner since the positioning guide ribs 37 are formed in the wall plates 31A and 31B of the connector housing 27 continuous from a position opposite to the base plate 30 to the position of the base plate 30. As a result, workability during insertion of the partitions 28 into the connector housing 27 is improved, and shifting in the position of the partitions 28 relative to the connector housing 27 can be prevented reliably.

The connector locking recess 56 locks the female connector 12, which is inserted into the receiving space 50, by engaging the connector locking projection 22, and thus prevents detachment of the female connector 12. The connector housing is not enlarged in the direction in which the wall plate 31A and 31B are arranged, i.e. in the row direction, because the connector locking recess 56 is formed not on the connector housing 27 but on the partition 28. The connection of the female connector 12 is thus ensured and the enlarging of the connector housing in the direction in which the wall plates 31A and 31B is prevented. As a result, it is possible to install, at high density and with small pitch, a plurality of the connector housings 27, in the direction in which the wall plates 31A and 31B of the connector housing 27 are arranged.

Interference between the partition 28 and the post pins 34 mounted in the terminal holes 35 can be avoided since the positioning guide ribs 37 are located at an intermediate position between the two adjacent terminal holes 35.

When mounting the partition 28 on the connecting housings 27, arranged in series at connecting ends, a pair of half guide ribs 39 formed at the connecting ends engage the positioning guide groove 48 of the partition and also a pair of half locking projections 42 formed at the connecting ends engage the partition locking recess 51 of the partition 28, furthermore, the arms 46A and 46B of the partition 28 and the partitioning plate 44 hold the connecting portions of the wall plates 31A and 31B, thus the connecting ends of the connector housings 27 are connected with each other. In this way, the connection between the connector housings 27 is ensured, and the walls are prevented from becoming weak due to the connection area. In addition, the number of parts is limited since the partition 27 also functions as a connecting member which connects the connector housings 27 with each other, compared with the case in which a separate member is used to connect the connector housings 27.

Figure 8:
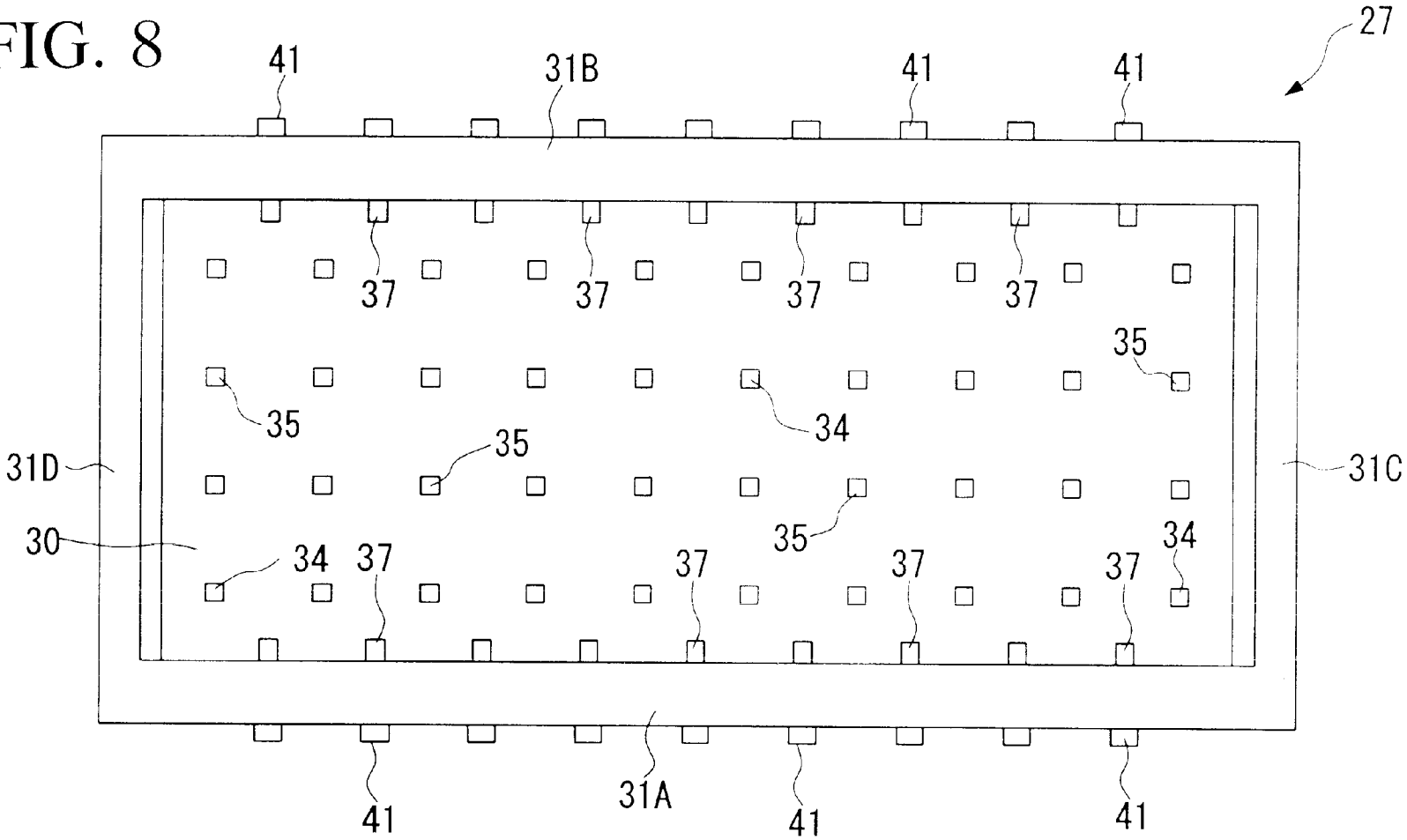
FIG. 8 is a plan view showing another form of a connector housing of the first embodiment of the general purpose connector according to the present invention.

The connector housing 27, described above, has a pair of wall plates 31A and 31B at a pair of edges of the base plate 30 and has no wall plates at the other pair of edges. However, it is possible to use another type of connector housing 27, as shown in FIG. 8, which is a so-called hood-shaped housing, and has a pair of wall plates 31A and 31B at a pair of edges of the base plate 30 and also has wall plates 31C and 31D at the other pair of edges, wherein each pair of the adjacent wall plates 31A to 31D are connected. In this case, the advantages described above are similarly obtained, however, the advantage regarding the connection of the connecting ends achieved by the partition 28 is excluded since the connector housings are not connected with each other.

Second Embodiment

Figure 9:
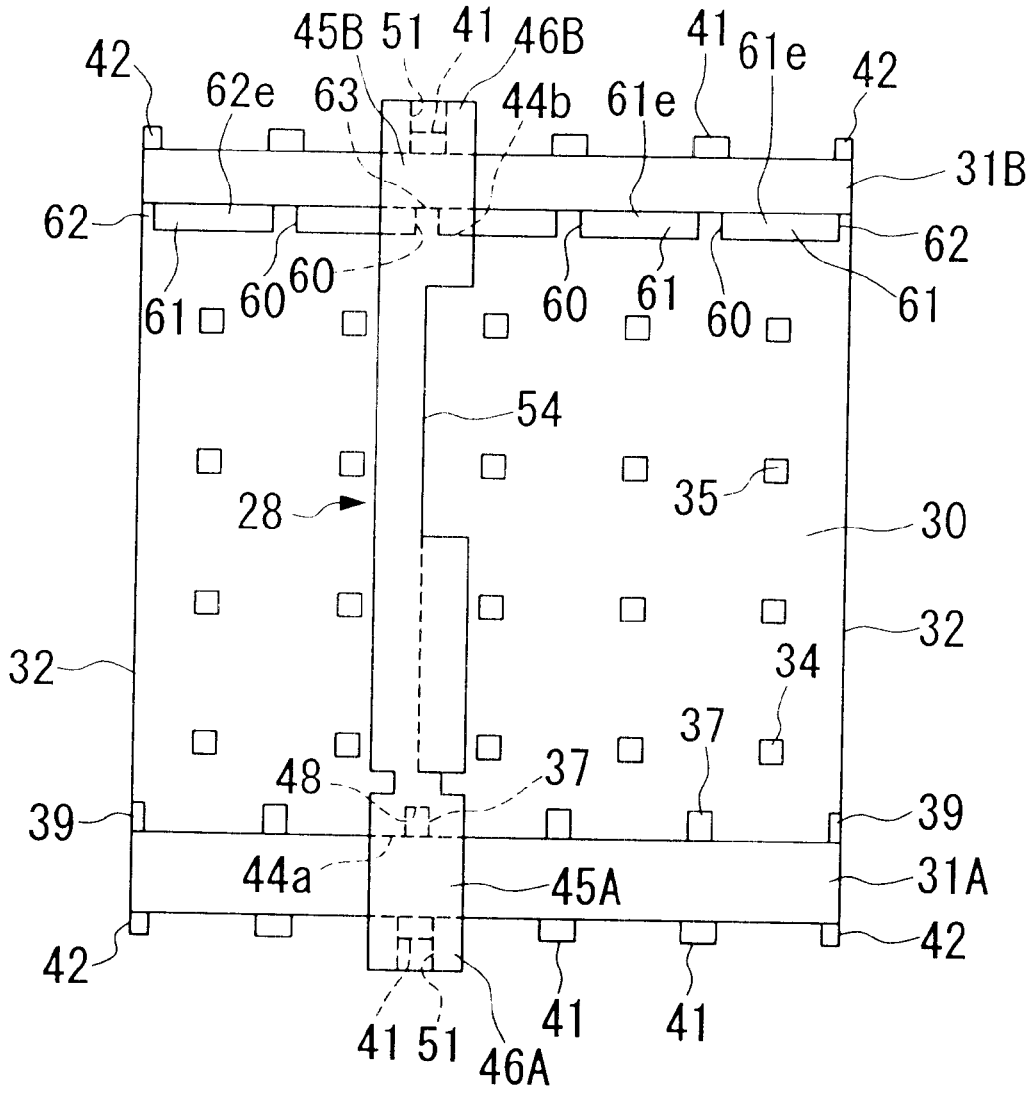
FIG. 9 is a plan view showing the connector housing and the partition of a second embodiment of the general purpose connector according to the present invention.

Hereinafter, a second embodiment of the present invention will be explained, mainly with reference to FIG. 9 and focussing on points of difference with the first embodiment. Those parts which are similar to those of the first embodiment will be referred to with the same reference numbers and will not be explained again. The second embodiment differs from the first embodiment in that the partition 28 is prevented from being inserted in a reversed orientation.

In the second embodiment, the wall plate 31A has positioning guide ribs 37 as in the first embodiment, however, the other wall plate 31B has positioning guide grooves (positioning guide means) 60 located at the same position as and instead of the positioning guide ribs 37. One positioning guide groove 60 is defined by two guide groove defining ribs 61 located either side of the positioning guide groove 60.

All of the positioning guide grooves 60 extend perpendicularly to the base plate 30 in the same way as the positioning guide ribs 37, are formed in the wall plate 31B continuous from a position opposite to the base plate 30 to the position of the base plate 30, and are formed in the same shape and in the same size as each other. Chamfers 61*e*, which incline toward the base plate 30 as they extend further inside the connector housing 27, are formed on all of the guide groove defining ribs 61, which define the positioning guide grooves 60, at the opposite ends to the base plate 30.

Half guide grooves 62 are formed at either end 32 of the wall plate 31B having the positioning guide grooves 60. The half guide groove 62 has a width in the row direction which is half of that of the guide groove 60 mentioned above and composes a complete positioning guide groove 60 with the adjacent half guide groove 60 formed on the adjacent connector housing 27.

In this second embodiment, a positioning guide groove 48 is formed on one side 44*a* facing the arm 46A of the partition 28 as in the first embodiment, however, a positioning guide rib 63 is formed on the other side 44*b* facing the arm 46B.

The positioning guide rib 63 is formed on the side 44*b* along the extending direction of the side 44*b*, continuous from the position of the projecting parts 45A and 45B to a position opposite to the projecting parts 45A and 45B, and is formed in a shape matching the positioning guide groove 60, so that it can slide into either of the positioning guide grooves 60.

The positioning guide groove 48 of each partition 28 is engaged with a desired one of the positioning guide ribs 37 formed in the wall plate 31A of the connector housing 27, and the positioning guide rib 63 is engaged with a desired one of the positioning guide grooves 60 formed in the wall plate 31B of the connector housing. These desired positioning guide rib 37 and the desired positioning guide groove 60 are located in the same row. In this way, the partition 28 is inserted into the connector housing 27, in a manner perpendicular to the wall plates 31A and 31B, while being guided by the positioning guide rib 37 and the positioning guide groove 60 of the connector housing 27. As a result, all of the mis-insertion prevention guide grooves 54 of the partitions 28 are automatically positioned on the same side in view of the arrangement direction of the connector housings 27.

In other words, if an attempt to insert the partition 28 is made with the mis-insertion prevention guide groove 54 facing the other side in view of the arrangement direction of the connector housings 27, the insertion will fail since the positioning guide groove 48 of the partition 28 cannot engage the positioning guide groove 60 of the connector housing 27 and the positioning guide rib 63 of the partition 28 cannot engage the positioning guide rib 37 of the connector housing 27.

As described above, the positioning guide rib 63 and the positioning guide groove 48 of the partition 28 and the positioning guide rib 37 and the positioning guide groove 60 of the connector housing 27 form partition-reversed insertion prevention means which mechanically prevent the partition 28 from being inserted into the connector housing 27.

Thus, in the second embodiment, the partition 28 is always inserted into the connector housing 27 in the correct orientation because reversed insertion of the partition 28 into the connector housing 27 is prevented.

Figure 10:
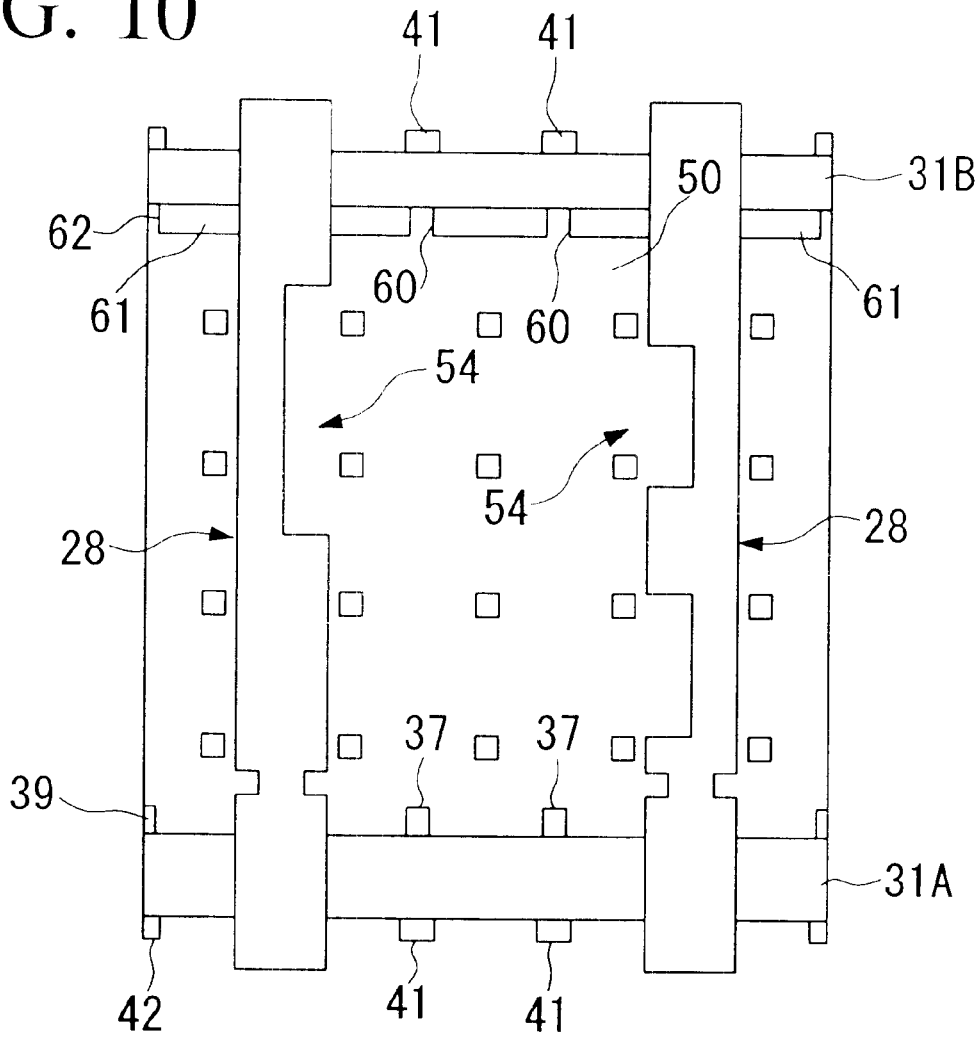
FIG. 10 is a plan view showing another form of a connector housing and partitions of the second embodiment of the general purpose connector according to the present invention.

A modification may be made to the second embodiment so that both surfaces of the partitions 28 facing the receiving space 50 have the mis-insertion prevention groove 54, as shown in FIG. 10, because visual prevention of the mis-insertion of the partition 28 is not necessary due to the mechanical means for preventing the mis-insertion described above. As a result of this modification, the number of arrangement patterns of the mis-insertion prevention groove 54 can be drastically increased.

Third Embodiment

Figure 11:
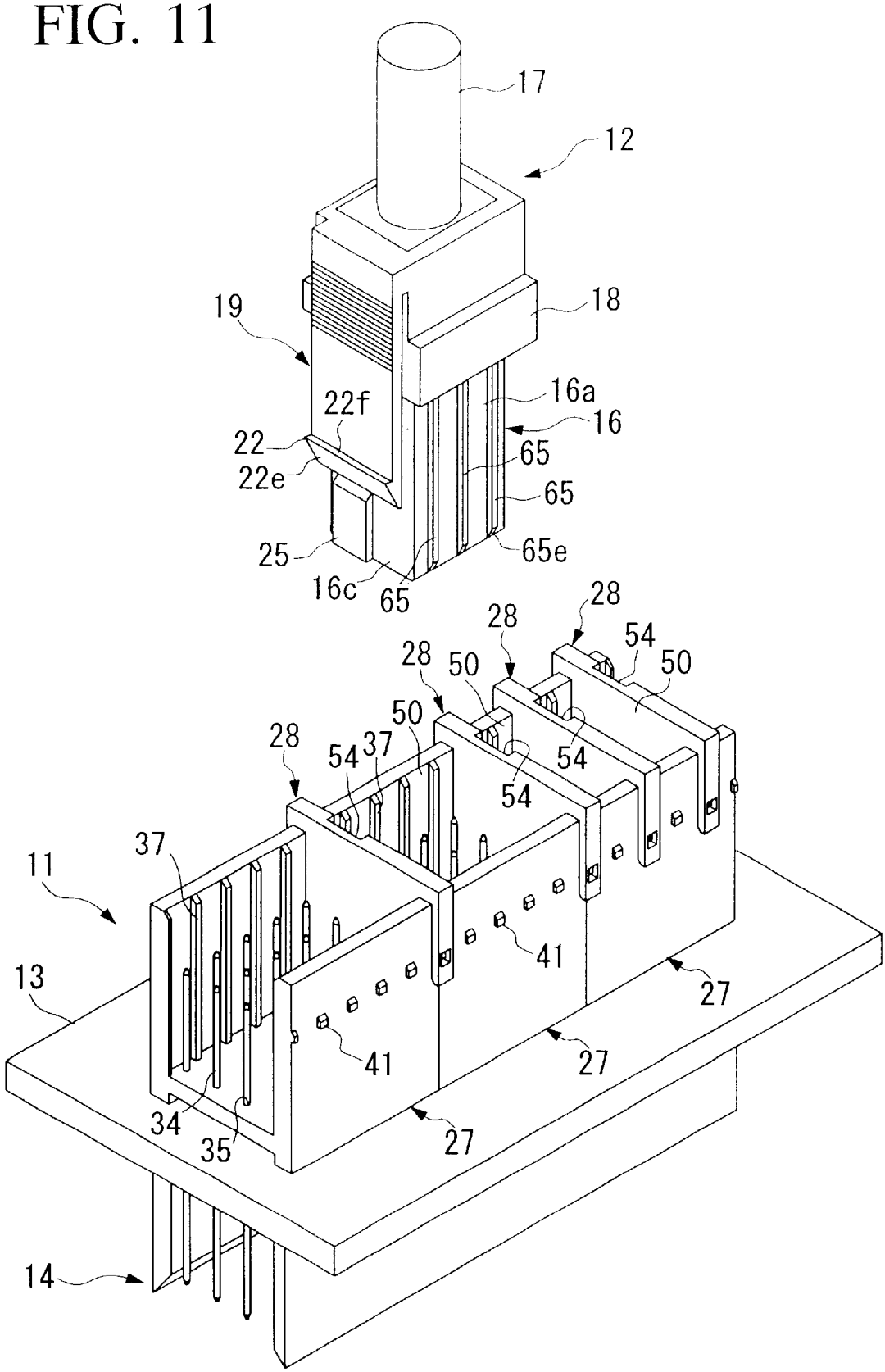
FIG. 11 is a perspective view showing a third embodiment of the general purpose connector according to the present invention.
Figure 12:
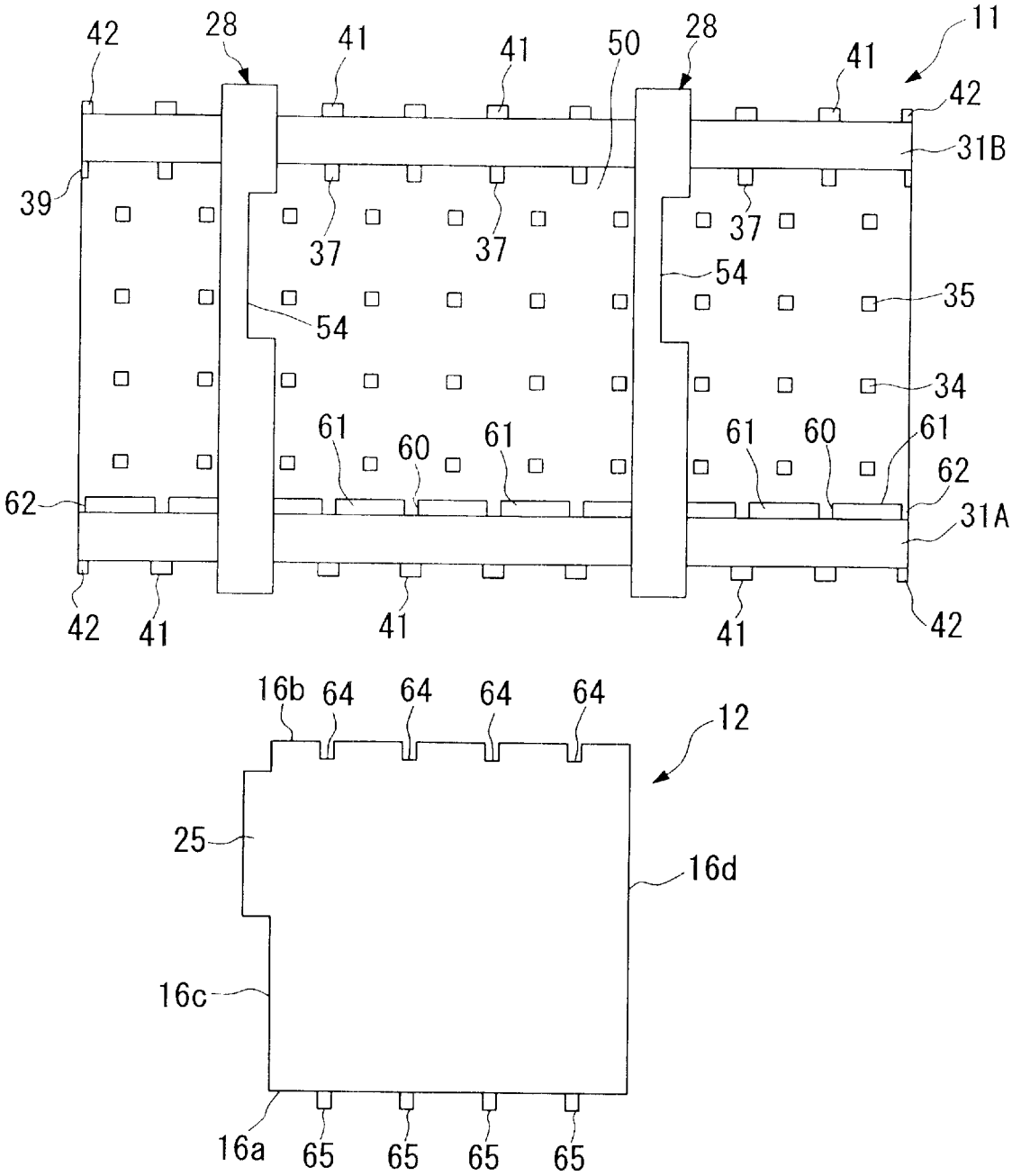
FIG. 12 is a plan view showing the third embodiment of the general purpose connector according to the present invention.

Hereinafter, a third embodiment of the present invention will be explained, mainly with reference to FIGS. 11 and 12 and focussing on points of difference with the second embodiment. Those parts which are similar to those of the second embodiment will be referred to with the same reference numbers and will not be explained again.

The third embodiment differs from the second embodiment in that the positioning guide ribs 37 are formed in the wall plate 31B and the positioning guide grooves 60 are formed in the wall plate 31A, and that the corresponding female connector 12 is prevented from being inserted in a reversed orientation by means of the positioning guide ribs 37 and the positioning guide grooves 60.

In the third embodiment, positioning guide ribs 37 which are similar to the ones in the second embodiment are formed in the wall plate 31A of the connector housing 27 and positioning guide grooves 60 which are similar to the ones in the second embodiment are formed in the wall plate 31B. The female connector 12 has reversed-insertion prevention grooves 64 formed on one of the side faces 16*a* and 16*b* of the insertion portion 16 which are perpendicular to the elastic connector lock 19. More specifically, the reversed-insertion prevention grooves 64, having the same pitch as that of the positioning guide ribs 37, extending along the insertion portion 16 and arranged in a direction perpendicular to the elastic connector lock 19, are formed on the side face 16*b* which faces the wall plate 31B having the positioning guide ribs 37 when the female connector 12 is inserted into the male connector 11 in the proper orientation.

All of the reversed-insertion prevention grooves 64, into which any positioning guide ribs 37 can be inserted, are formed continuous over the entire extending region of the insertion portion 16, and are formed in the same shape and in the same size as each other.

Reversed-insertion prevention ribs 65, having the same pitch as that of the positioning guide grooves 60, extending along the insertion portion 16 and arranged in a direction perpendicular to the elastic connector lock 19, are formed on the other side face 16*b* of the insertion portion 16 of the female connector 12, which faces the wall plate 31A having the positioning guide grooves 60 when the female connector 12 is inserted into the male connector 11 in the proper orientation.

All of the reversed-insertion prevention ribs 65, which can be inserted into any positioning guide grooves 60, are formed continuous over the entire extending region of the insertion portion 16, and are formed in the same shape and in the same size as each other. Chamfers 65*e*, which incline toward the insertion portion 16 as it approaches the end of the insertion portion 16, are formed on all of the reversed-insertion prevention ribs 65 at each end.

The reversed-insertion prevention grooves 64 of the female connector 12 engage the positioning guide ribs 37 formed on one wall plate 31B of the male connector 11, and the reversed-insertion prevention ribs 65 of the female connector 12 engage the positioning guide grooves 60 formed on the other wall plate 31A of the male connector 11 when the female connector 12 is inserted into the male connector 11 in the proper orientation. While in contrast, the reversed-insertion prevention ribs 65 of the female connector 12 interfere with the positioning guide ribs 37 of the male connector 11, and the reversed-insertion prevention grooves 64 of the female connector 12 interfere with the positioning guide grooves 60 of the male connector 11 when an attempt is made to insert the female connector 12 into the male connector 11 in a reversed orientation, thus reversed insertion of the female connector 12 into the male connector 11 is prevented.

In the third embodiment, reversed-insertion prevention means such as grooves for the female connector 12 are not required on the partitions 28 since the positioning guide ribs 37 and the positioning guide grooves 60 formed in the wall plates are utilized in order to prevent the reversed insertion of the female connector 12 as described above.

Fourth Embodiment

Figure 13:
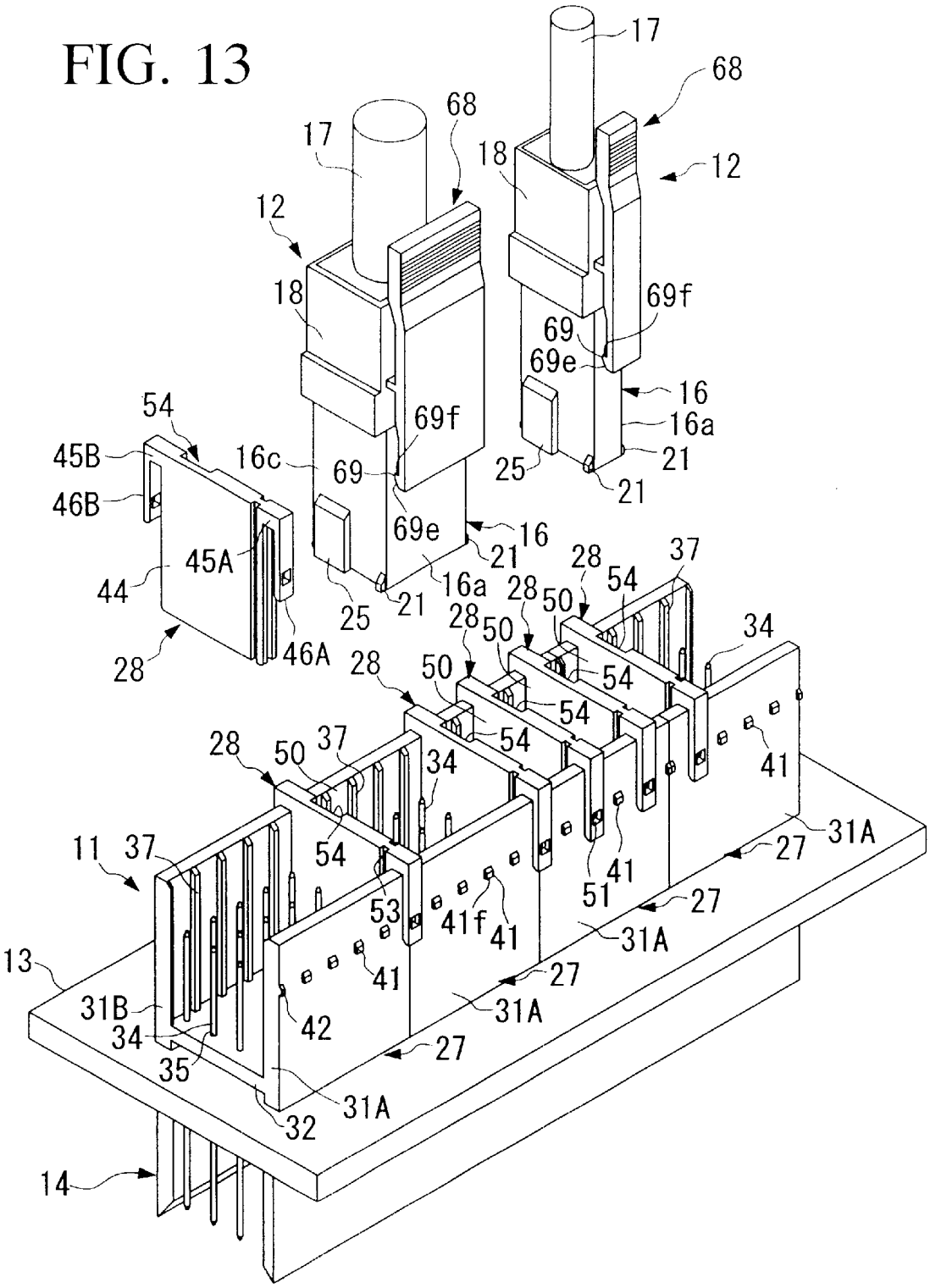
FIG. 13 is a perspective view showing a fourth embodiment of the general purpose connector according to the present invention.
Figure 14:
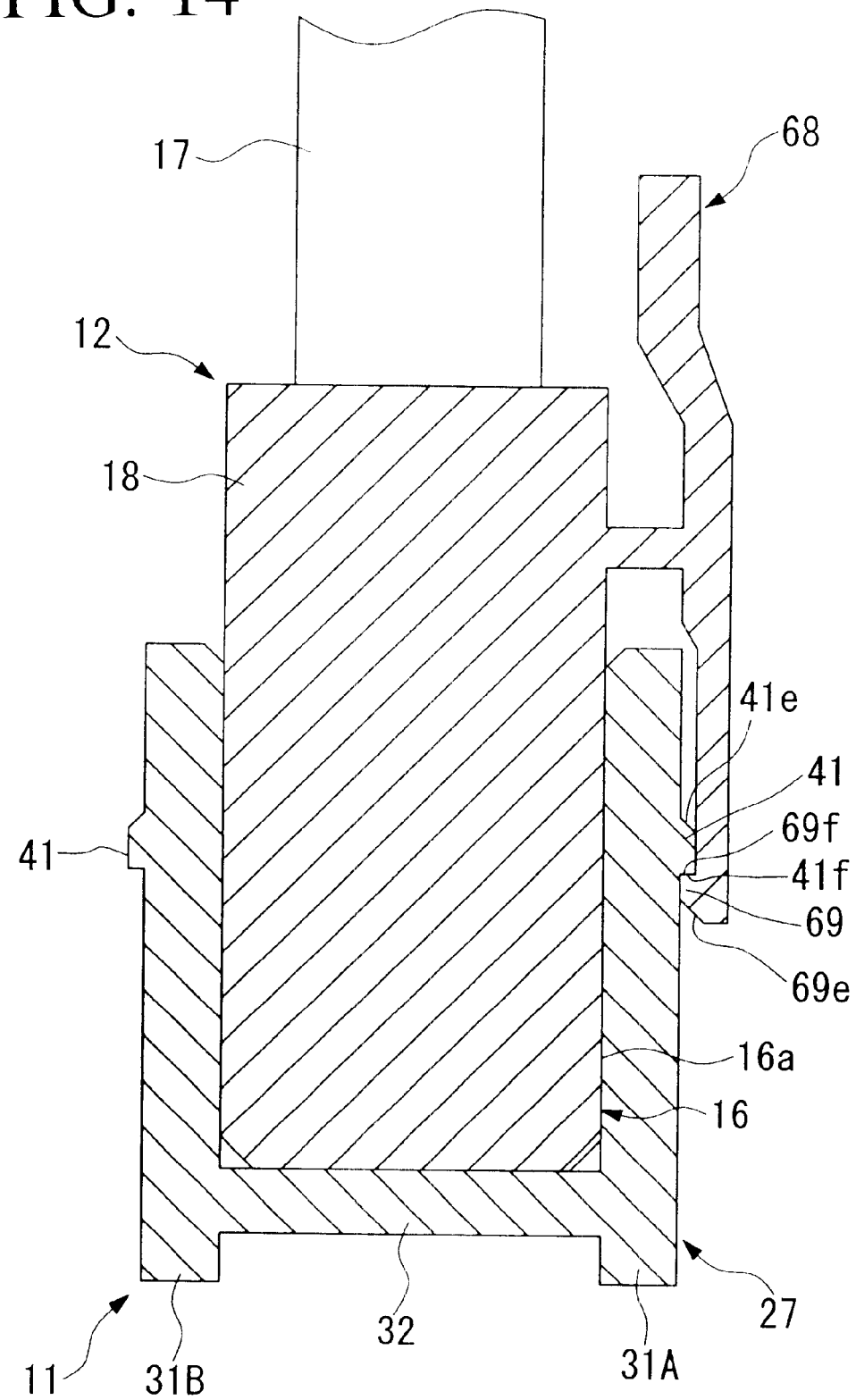
FIG. 14 is a cross-sectional view showing a female connector connected to the fourth embodiment of the general purpose connector according to the present invention.

Hereinafter, a fourth embodiment of the present invention will be explained, mainly with reference to FIGS. 13 and 14 and focussing on points of difference with the first embodiment. Those parts which are similar to those of the first embodiment will be referred to with the same reference numbers and will not be explained again. The fourth embodiment differs from the first embodiment in the structure for locking the female connector 12 to the male connector 11.

In the fourth embodiment, the female connector 12 has an elastic connector lock 68 formed on the side face 16*a* of the insertion portion 16 in the region of the support part 18. The elastic connector lock 68 is formed on the support part 18 and extends along the side face 16*a*. The elastic connector lock 68 is supported by the support part 18, at the middle of its length, and has a connector locking projection 69 projecting toward the insertion portion 16. The connector locking projection 69 comprises a chamfer 69*e* which inclines toward the side away from the insertion portion 16 as it approaches the tip. A stop face 69*e* being perpendicular to the extending direction of the insertion portion 16 is formed opposite the connector locking projection 69.

During the insertion of the insertion portion 16 of the female connector 12 into the corresponding receiving space 50 of the male connector 11, the connector locking projection 69 slides on the outer surfaces of the wall plates 31A of the connector housing 27, and then is pressed by the partition locking projection 41 and the elastic connector lock 68 is elastically deformed. As the insertion progresses, the connector locking projection 69 passes over the partition locking projection 41 and engages it. At this moment, the stop face 69*f* of the connector locking projection 69 and the stop face 41*f* of the partition locking projection 41 oppose and make contact with each other, thus the female connector 12 is locked in the male connector 11 by the engagement of the stop faces 41*f* and 69*f*.

On the other hand, after having this locking state, if the elastic connector lock 68 is swung by pressing the elastic connector lock 68 at a part opposite to the connector locking projection 69 toward the support part 18, the stop faces 41*f* and 69*f* are released from their opposing positions and then it is possible to pull the female connector 12 out of the male connector 11.

In the fourth embodiment, as explained above, the arrangement pitch of the connector housings 27 can be reduced since the elastic connector lock 68 is disposed in a direction perpendicular to the arrangement direction of the connector housings 27. In addition, female connector locking means such as grooves are not required in the male connector 11 since the partition locking projection 41 is utilized in order to lock the female connector 12.

Fifth Embodiment

Figure 15:
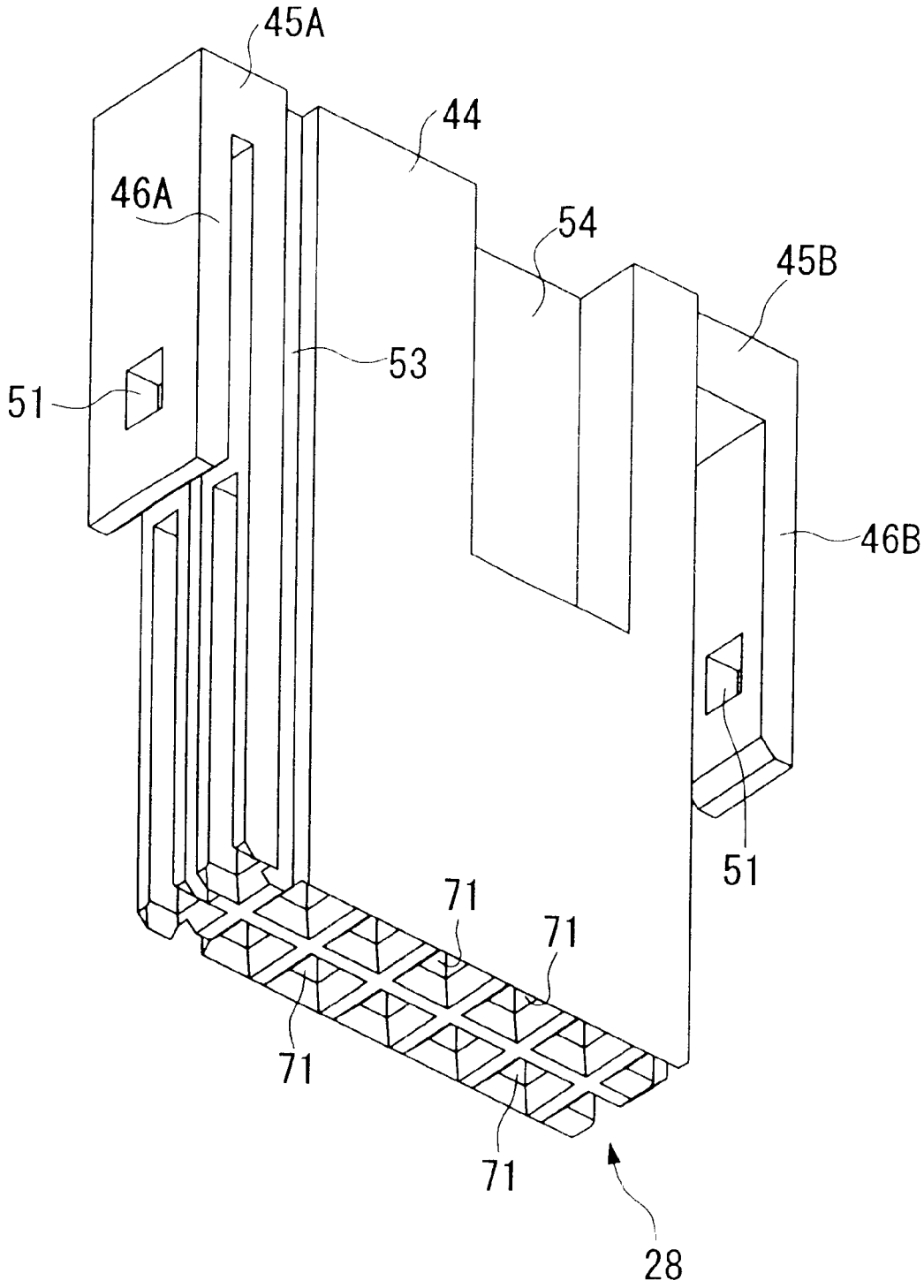
FIG. 15 is a perspective view showing the partition of a fifth embodiment of the general purpose connector according to the present invention.

Hereinafter, a fifth embodiment of the present invention will be explained, mainly with reference to FIGS. 15 and 16 and focussing on points of difference with the first embodiment. Those parts which are similar to those of the first embodiment will be referred to with the same reference numbers and will not be explained again. The fifth embodiment differs from the first embodiment in that the arms 46A and 46B of the partition 28 are completely accommodated in the connector housing 27, that reversed insertion of the partition 28 is prevented, and that the pin-shaped post pins 4 are inserted into the partition 28.

In the fifth embodiment, an engaging groove 70A is formed on the outer surface of the wall plate 31A at a position opposite to the base plate 30, and another engaging groove 70B, which has the same depth as the engaging groove 70A, is formed on the outer surface of the wall plate 31B at a position opposite to the base plate 30 as well. The partition locking projections 41 are disposed in these engaging grooves 70A and 70B. The wall plates 31A and 31B are different from each other in thickness, and corresponding to this the projecting lengths of the projecting parts 45A and 45B, i.e. the distances between the partitioning plate 44 and the arm 46A or 46B, are different from each other. One wall plate 31B of the connector housing 27 is thicker than the other wall plate 31A as shown in FIG. 16. The gap between the partitioning plate 44 and the arm 46B which is located on the side near the thicker wall plate 31B when the partition 28 is inserted into the connector housing 27 in the proper orientation is formed relatively wide, in other words, the length of the projecting part 45B is formed relatively long, so that the gap accommodates the thicker wall plate 31B, as shown in FIG. 15. Similarly, the gap between the partitioning plate 44 and the arm 46A which is located on the side near the thinner wall plate 31A is formed relatively narrow, in other words, the length of the projecting part 45A is formed relatively short, so that the gap appropriately accommodates the thinner wall plate 31A.

Based on the construction described above, reversed insertion of the partition 28 into the connector housing 27 is prevented since the arm 46A of the partition 28, which forms a narrower gap with the partitioning plate 44, interferes with the thicker wall plate 31B when an attempt is made to insert the partition 28 into the connector housing 27 in a reversed orientation. While in contrast, the narrower gap between the partitioning plate 44 and the arm 46A appropriately accommodates the thinner wall plate 31A and the wider gap between the partitioning plate 44 and the arm 46B appropriately accommodates the thicker wall plate 31B when an attempt is made to insert the partition 28 into the connector housing 27 in the proper orientation. The partition locking projections 41 formed on the connector housing 27 engage the partition locking recesses 51 formed in the arms 41A and 41B, so that the partition 28 is locked to the connector housing 27. The arms 46A and 46B of the partition 28 are respectively accommodated in the engaging groove 70A and 70B formed in the wall plates 31A and 31B of the connector housing 27 so that the outer surfaces of the arms 46A and 46B of the partition 28 and the outer surfaces of the wall plate 31A and 31B of the connector housing 27 respectively form flat surfaces.

The partitioning plate 44 of the partition 28 and the arm 46A forming the narrower gap compose partition-reversed insertion prevention means which prevent the partition 28 from being inserted into the connector housing 27 in a reversed orientation. As explained above, in the fifth embodiment, it is ensured that the partition 28 is inserted into the connector housing 27 in the proper orientation since reversed insertion of the partition 28 into the connector housing 27 is prevented.

In the fifth embodiment, the terminal holes 35 of the connector housing 27 are also formed in the region where the partition 28 is to be disposed, and a plurality of engaging holes 71, which can accommodate the post pins 34 of the connector housing 27, are formed in the partitioning plate 44 of the partition 28 at the leading edge. The engaging holes 71 can engage the post pins 34 mounted on the base plate 30 wherever the partition 28 is inserted into the connector housing 27 with its positioning guide grooves 48 being guided by the positioning guide ribs 37.

The partition 28 is supported by the post pins 34 and thus shifting in the position of the partition 28 relative to the connector housing 27 is prevented reliably in the fifth embodiment because the post pins 34 are inserted into the engaging holes 71 of the partition 28. In addition, the partition 28 can be mounted even when the terminals are so densely arranged with a small pitch that the partition 28 cannot be disposed between the post pins 34. In this case, the engaging holes 71 may be formed as loose holes which do not make contact with the post pins 34 in order to reuse the post pins 34. For this purpose, the post pins 34 inserted into the engaging holes 71 of the partition 28 do not function as signal-transmission lines.

In the fifth embodiment, the mis-insertion prevention groove 54 is formed in a limited region in the upper portion of the partitioning plate 44, and accordingly the mis-insertion prevention projection 25 of the female connector 12 is formed in a limited region in the upper portion of the insertion portion 16, although that is not shown in the drawings.

Figure 16:
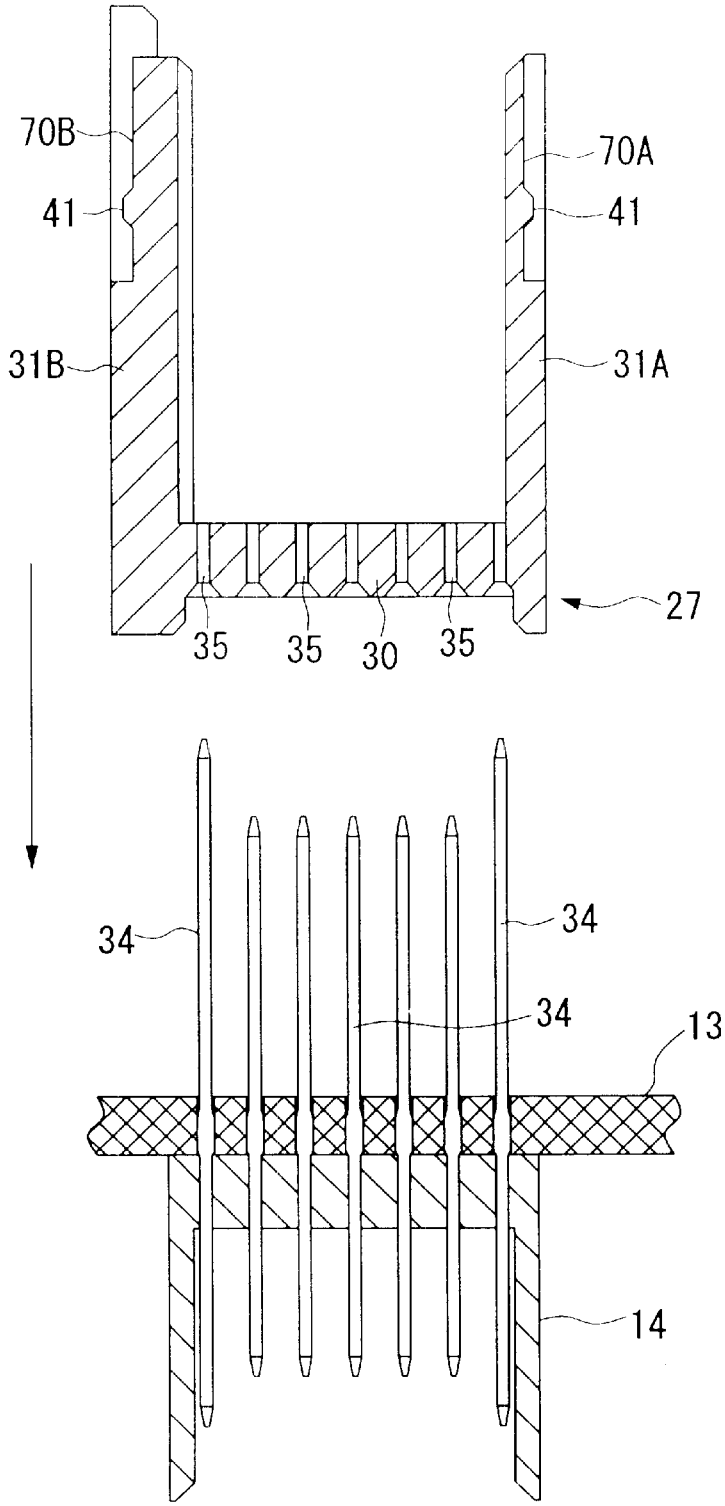
FIG. 16 is an exploded-sectional side view showing the connector housing and so on of the fifth embodiment of the general purpose connector according to the present invention.
Figure 17:
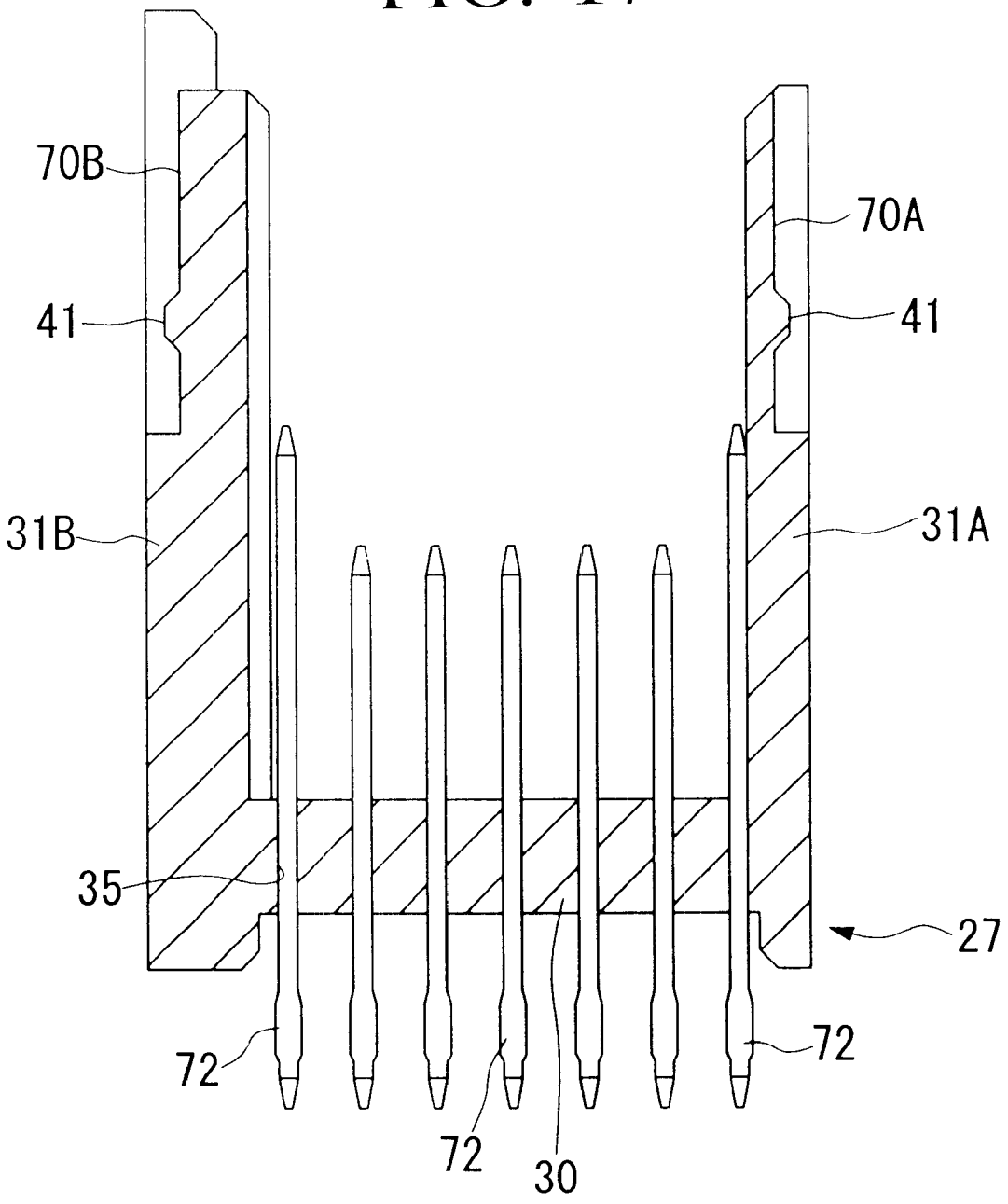
FIG. 17 is a sectional side view showing another form of a connector housing and so on of the fifth embodiment of the general purpose connector according to the present invention.

In the preferred embodiments including the fifth embodiment, the post pins 34 having been mounted in the printed circuit board 13 are inserted into the connector housing 27 as shown in FIG. 16, however, it is also conceivable that post pins 72 for press-fitting be mounted in the connector housing first, as shown in FIG. 17, then the connector housing would be mounted onto the printed circuit board 13 with the post pins 72 being pressed into the printed circuit board 13.

Sixth Embodiment

Hereinafter, a sixth embodiment of the present invention will be explained, mainly with reference to FIGS. 18 and 19 and focussing on points of difference with the fourth embodiment. Those parts which are similar to those of the fourth embodiment will be referred to with the same reference numbers and will not be explained again. The sixth embodiment differs from the fourth embodiment in that the partition is made of metal and that a shielding member made of metal is disposed inside the connector housing 27 in order to block undesired electromagnetic waves.

Figure 18:
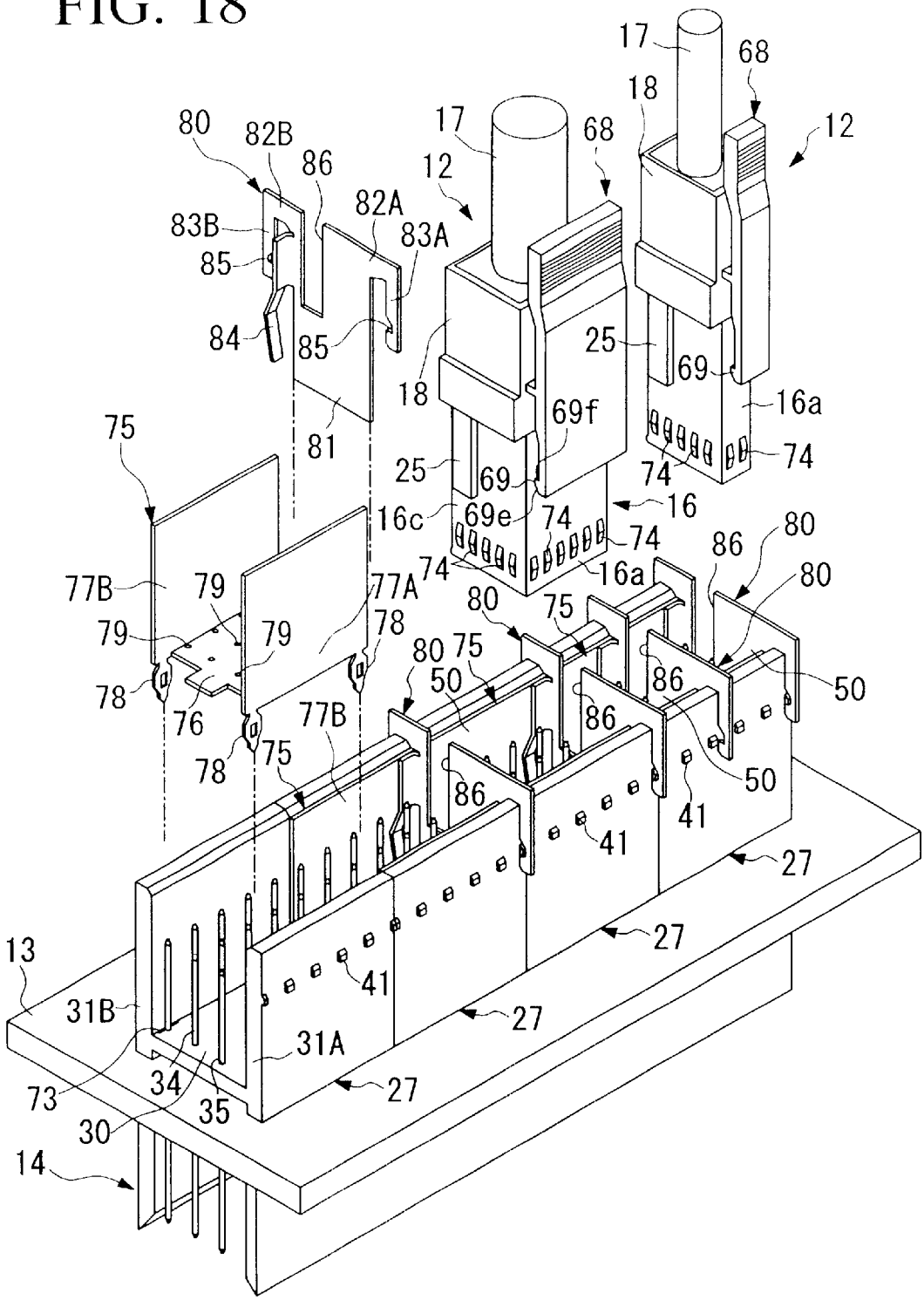
FIG. 18 is a perspective view showing a sixth embodiment of the general purpose connector according to the present invention.
Figure 19:
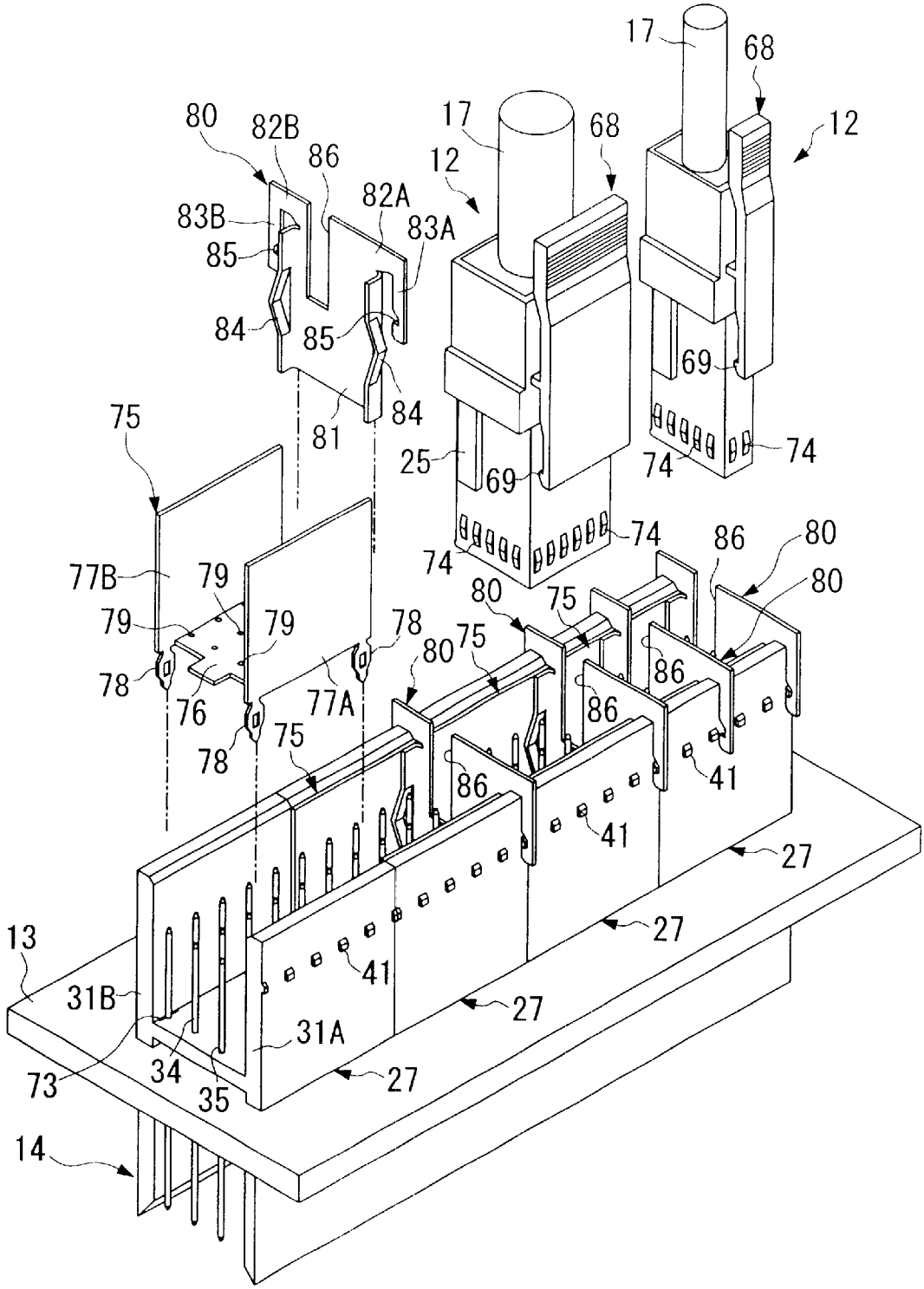
FIG. 19 is a perspective view showing another form of a sixth embodiment of the general purpose connector according to the present invention.

As shown in FIG. 18, the female connector 12 has grounding springs 74 exposed on the leading region of all of the side faces of the insertion portion 16. The shielding member 75 is disposed inside the connector housing 27. The shielding member 75 is made of a conductive metal plate by press forming. It comprises a rectangular base plate 76 and a pair of wall plates 77A and 77B, which are rectangular shaped and,parallel to each other, extending from a pair of edges of the base plate 76 in a direction perpendicular to the base plate 76. Wall plates are not formed on the other pair of edges of the base plate 76 perpendicular to the wall plates 77A and 77B. The shielding member 75 is disposed inside the connector housing 27 with its base plate 76 being located on the base plate 30 of the connector housing 27 and with a pair of the wall plates 77A and 77B being in contact with the inside of the wall plates 31A and 31B, respectively. Positioning guide ribs are not formed on the inside surfaces of the wall plates 31A and 31B of the connector housing 27.

The shielding member 75 has connecting parts 78 for press fitting which extend downward from either side of the wall plates 77A and 77B. The shielding member 75 is properly positioned relative to the connector housing 27 by means of the connecting parts 78 being inserted into through holes 73 (only one of them is shown in FIG. 18) formed through the base plate 30 of the connector housing 27. The connecting parts 78 are press-fitted into the printed circuit board 13 and are connected to its grounding layer.

The shielding member 75 has terminal holes 79 formed through the base plate 76 each of which is located at the position of the corresponding terminal hole 35 of the connector housing 27 when the shielding member 75 is disposed in the connector housing 27. The post pins 34 pass through both of the connector housing 27 and the shielding member 75.

The partition 80 in the sixth embodiment is made of a conductive metal plate by press forming. It comprises a partitioning plate 81 having a rectangular shape and being inserted between the pair of the wall plates 77A and 77B of the shielding member 75, a pair of projecting parts 82A and 82B projecting outwardly from the top end of the partitioning plate 81, and a pair of arms 83A and 83B extending downward parallel with the edge of the partitioning plate 81 from the outermost ends of the projecting parts 82A and 82B and contacting the outer surface of the pair of the wall plates 31A and 31B of the connector housing 27, and a conducting part 84 only extending from the partitioning plate 81 near the arm 83B and having contact with the shielding member 75.

The width of the partitioning plate 81 is approximately the same as the distance between the wall plates 77A and 77B of the shielding member 75, and the length of the part of the partitioning plate 81 excluding the projecting parts 82A and 82B is approximately the same as the height of the wall plates 77A and 77B of the shielding member 75.

The arms 83A and 83B have partition locking recesses 85 at their inside middle positions, which are similar to the partition locking recesses 51 described before and which engage the partition locking projection 41 of the connector housing 27. A mis-insertion prevention recess 86 (mis-insertion prevention means) being similar to the mis-insertion prevention groove 54 as described before is formed in the upper portion of the partitioning plate 81, and accordingly the mis-insertion prevention projection 25 of the female connector 12 is formed in a limited region in the upper portion of the insertion portion 16.

In a similar manner as described before, the mis-insertion prevention recess 86 prevents incorrect insertion wherein a wrong female connector 12 having non-matching signal-transmission lines and matching terminal arrangement is inserted, and also prevents reversed insertion wherein the corresponding female connector 12 having matching signal-transmission lines is inserted in a reversed orientation, as a result of working in cooperation with the female connector 12.

The conducting part 84 of the shield member 75 makes contact with the wall plate 77B when the partition 80 is mounted on the shield member 75 disposed in the connector housing 27. When the female connector 12 is inserted into the receiving space 50 defined by the partition 80, the other partition 80, and the connector housing 27 with the shield member 75, the grounding springs 74 make contact with a pair of the partitions 80 and the wall plates 77A and 77B of the shield member 75. The grounding springs 74 of the female connector 12 are grounded to the grounding layer of the printed circuit board 13 via the shield member 75 and the conducting part 84 of the partitions 80, or only via the shield member 75.

Thus, the shielding effect is enhanced since undesired electromagnetic waves, which are emitted when high frequency signals are transmitted, are blocked by the partitions 80 and the shield member 75. As shown in FIG. 19, the conducting part 84 may be formed on either side, i.e. near the arms 83A and 83B, of the partitioning plate 81 of the partition 80.

Seventh Embodiment

Figure 20:
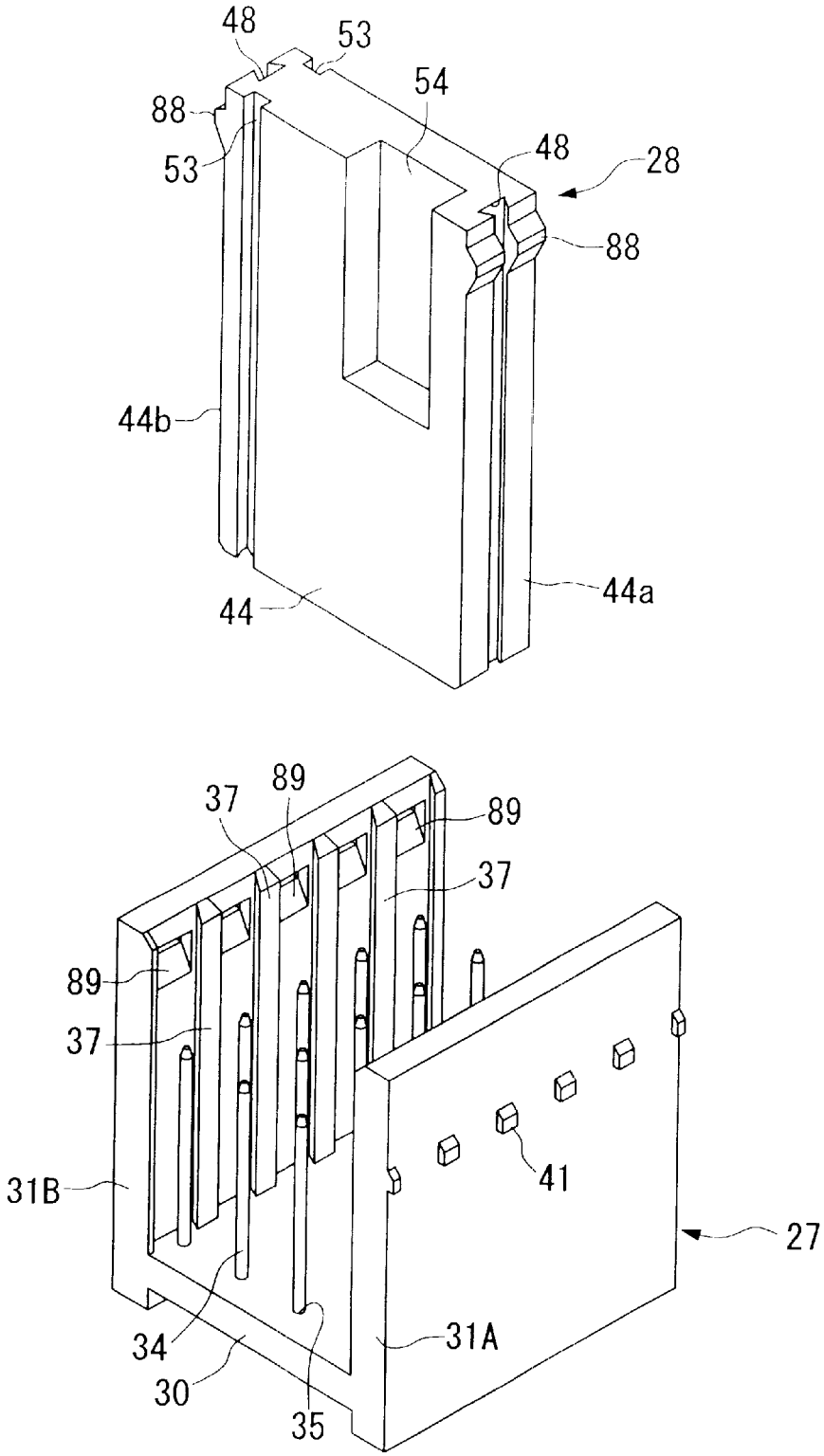
FIG. 20 is a perspective view showing a seventh embodiment of the general purpose connector according to the present invention.

Hereinafter, a seventh embodiment of the present invention will be explained, mainly with reference to FIG. 20 and focussing on points of difference with the first embodiment. Those parts which are similar to those of the first embodiment will be referred to with the same reference numbers and will not be explained again. The seventh embodiment differs from the first embodiment in the structure for locking the partition 28 to the connector housing 27.

In the seventh embodiment, the partition 28 only has the partitioning plate 44 to be disposed between the wall plates 31A and 31B. A partition locking projection 88 is formed on either side face 44*a* and 44*b* at positions corresponding to each other along the length of the partitioning plate 44. The positioning guide grooves 48 formed on the side faces 44*a* and 44*b* of the partitioning plate 44 have a cuneate shape such that the base of the groove is wider than the entry.

Corresponding to the partitioning plate 44, partition locking recesses 89 which engage the partition locking projection 88 are respectively formed on the inside surface of the wall plate 31A and 31B of the connector housing 27 at a position opposite to the base plate 30. The positioning guide ribs 37 formed inside the connector housing have a cuneate shape such that the top of the rib is wider than the base (only the ribs 37 on the wall plate 31B are shown in FIG. 20). The partition 28 is locked to the connector housing 27 so that the partition locking projections 88 formed on either side of the partitioning plate 44 engage the partition locking recesses 89 when the partition 28 is inserted into the connector housing 27 with its positioning guide grooves 48 being guided by the positioning guide ribs 37 of the wall plates 31A and 31B.

Thus, the partition 28 can be locked to the connector housing 27 without forming projecting parts and arms on the partition 28, in other words, accommodating all of the partition 28 inside the connector housing 27. In addition, deformation of the wall plates 31A and 31B can be avoided with the partition 28 as a whole being accommodated in the connector housing 27 because the positioning guide grooves 48 of the connector housing 27 and the positioning guide ribs 37 are formed cuneate and engage each other. Due to these facts, the width of the male connector 11 measured in the direction in which the wall plates 31A and 31B of the connector housing 27 are arranged (in the row direction) can be reduced, as a result, the mounting pitch of the male connector 11 in that direction can be minimized.

Eighth Embodiment

Hereinafter, an eighth embodiment of the present invention will be explained, mainly with reference to FIGS. 21 through 26B and focussing on points of difference with the first embodiment. Those parts which are similar to those of the first embodiment will be referred to with the same reference numbers and will not be explained again. The eighth embodiment differs from the first embodiment in that the partition is also disposed in the row direction in addition to the column direction.

Figure 21:
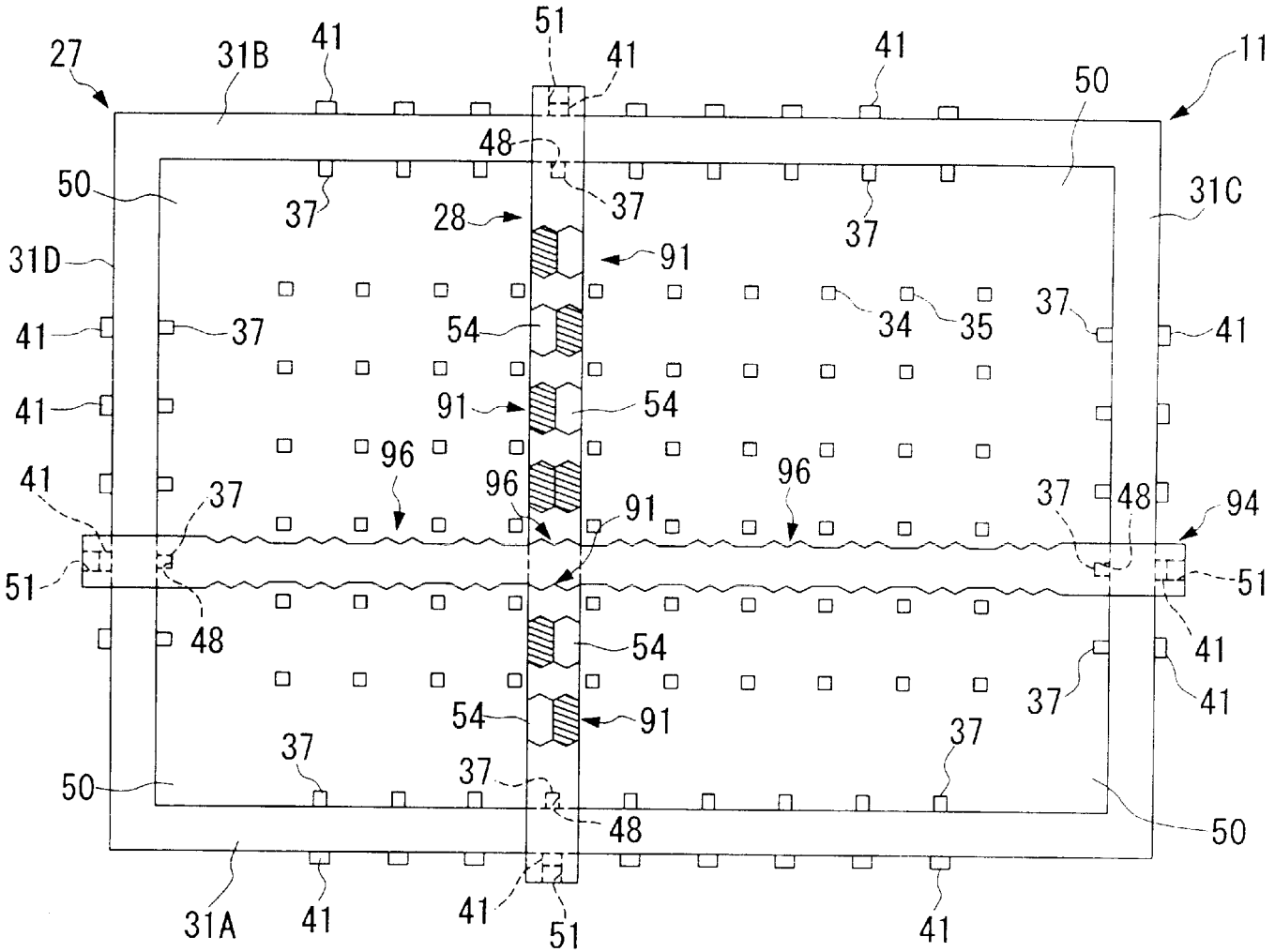
FIG. 21 is a plan view showing an eighth embodiment of the general purpose connector according to the present invention.

As shown in FIG. 21, the connector housing 27 used in the eighth embodiment is a so-called hood-shaped housing, which has a pair of wall plates 31A and 31B at a pair of edges of the base plate 30 and also has wall plates 31C and 31D at the other pair of edges, wherein each pair of the adjacent wall plates 31A to 31D are connected to each other. The positioning guide ribs 37 and the partition locking projections 41 are also formed on the wall plates 31C and 31D arranged in the column direction in addition to the wall plates 31A and 31B arranged in the row direction.

Figure 22A:
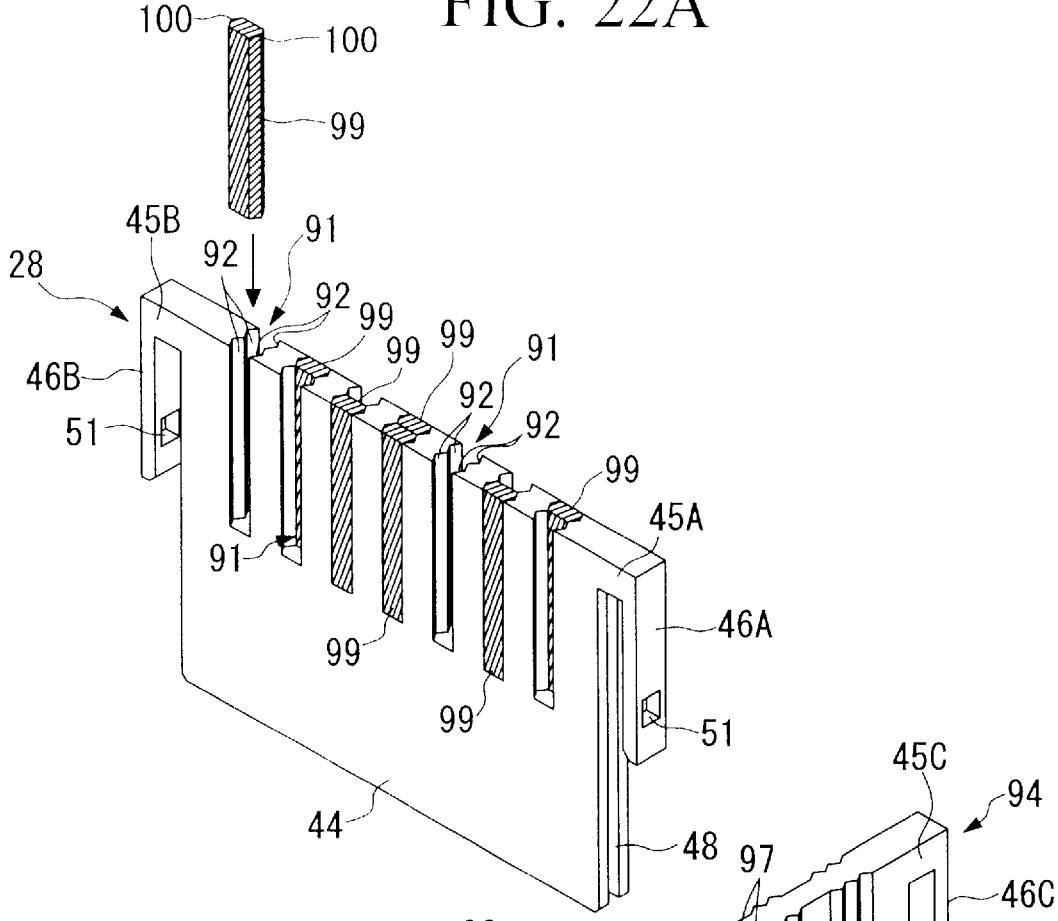
FIG. 22A is a perspective view showing a partition of the eighth embodiment of the general purpose connector according to the present invention.
Figure 22B:
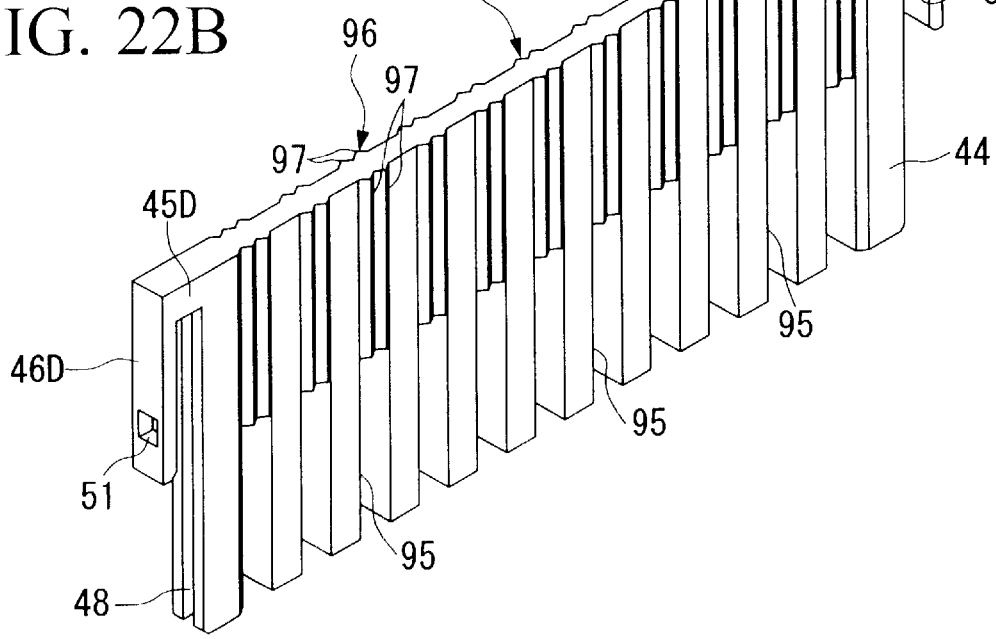
FIG. 22B is a perspective view showing a cross partition of the eighth embodiment of the general purpose connector according to the present invention.

As shown in FIGS. 22A and 22B, cross positioning guide grooves 91 (cross positioning guide means) extending from the top end of the partitioning plate 44 downward to a designated position are formed with the same pitch as in the positioning guide ribs 37. The positions of the cross positioning guide grooves 91 coincide, in the row direction, with the positions of the positioning guide ribs 37 formed on the wall plates 31C and 31D when the partition 28 is mounted between a pair of the wall plates 31A and 31B which are perpendicular to the wall plates 31C and 31D and arranged in the row direction. The cross positioning guide groove 91 is formed by arranging two pairs of opposing engaging grooves 92, side by side, in the thickness direction of the partition 28.

A cross partition 94 mounted perpendicular to the partition 28 divides the connector housing 27 in the row direction and forms receiving spaces 50 together with the connector housing 27 and the partition 28. The cross partition 94 is made by injection molding of a synthetic resin or the like, in the same way as the partition 28. The partition 94 comprises a partitioning plate 44 having a rectangular shape and being inserted between a pair of the wall plates 31C and 31D of the connector housing 27, a pair of projecting parts 45C and 45D projecting outwardly from the top end of the partitioning plate 44, and a pair of arms 46C and 46D extending downward parallel with the side edges of the partitioning plate 44 from the outermost ends of the projecting parts 45C and 45D and making contact with the outer surface of a pair of the wall plates 31C and 31D of the connector housing 27.

A plurality of engaging grooves 95, extending from the bottom of the cross partition 94 to a designated position, are formed in the cross partition 94, and cross positioning guide engagements 96 (cross positioning guide means) are formed on the upper part of the cross partition 94. The pairs of the engaging groove 95 and the cross positioning guide engagements 96 are arranged with the same pitch as for the positioning guide ribs 37.

The positions of the engaging grooves 95 and of the cross positioning guide engagements 96 coincide, in the column direction, with the positions of the positioning guide ribs 37 formed on the wall plates 31A and 31B when the cross partition 94 is mounted between a pair of the wall plates 31C and 31D which are perpendicular to the wall plates 31A and 31B and arranged in the column direction. At that time, one of the cross positioning guide engagements 96 engages one of the cross positioning guide grooves 91 of the partition 28.

The cross positioning guide engagements 96 are formed so that they can engage any one of the cross positioning guide grooves 91. The cross positioning guide engagement 96 is formed by arranging side by side two pairs of engaging projections 97, each projection projecting outward from the partition 94.

A mis-insertion prevention key 99 is to be inserted between a pair of engaging grooves 92 forming the cross positioning guide groove 91. The mis-insertion prevention key 99 has about half the thickness of the partition 28, and has a pair of engaging projections 100 projecting oppositely so that the mis-insertion prevention key 99 fits between a pair of engaging grooves 92. A plurality of the mis-insertion prevention keys 99 formed in the same shape are used at the same time.

According to the eighth embodiment, the receiving spaces 50, which accept female connectors 12, can also be formed and arranged in the row direction in addition to the column direction, by engaging one of the cross positioning guide grooves 91 of the partition 28 with one of the cross positioning guide engagements 96 of the cross partition 94. Mis-insertion prevention guide grooves 54 for the female connectors 12 can be formed respectively at desired positions in the receiving spaces 50 by inserting the mis-insertion prevention keys 99 into some of the cross positioning guide grooves 91 which are not engaged with the cross partition 94. Although they are not shown, the female connectors 12 will have mis-insertion prevention projections corresponding to the mis-insertion prevention guide grooves 54.

Each receiving space 50 can be differentiated from others by the pattern of the mis-insertion prevention guide grooves 54 defined by the mis-insertion prevention keys 99, since partition 28 has many of the cross positioning guide grooves 91 and each receiving space 50 is allocated at least one cross positioning guide groove 91 which can be used for accommodating the mis-insertion prevention key 99. The cross positioning guide grooves 91 of the partition 28 and the cross positioning guide engagements 96 of the cross partition 94 form the cross positioning guide means which enable the engaging position between the partition 28 and the cross partition 94 to be changed by regular intervals.

In the eighth embodiment, the receiving spaces 50 can also be formed and arranged in the row direction in addition to the column direction since the cross partition 94 forms the receiving spaces 50 together with the connector housing 27 and the partition 28 when the cross partition 94 is fitted perpendicular to the partition 28. Therefore, it is possible to cope with a situation in which a plurality of terminal arrangements are required in both the row and the column directions.

It is possible to easily and accurately define the mounting position of the partition 28 and the cross partition 94 since the partition 28 and the cross partition 94 have the cross positioning guide grooves 91 and the cross positioning guide engagements 96 respectively with which the mutual positioning of the partition and the cross partition can be changed by regular intervals.

Figure 23:
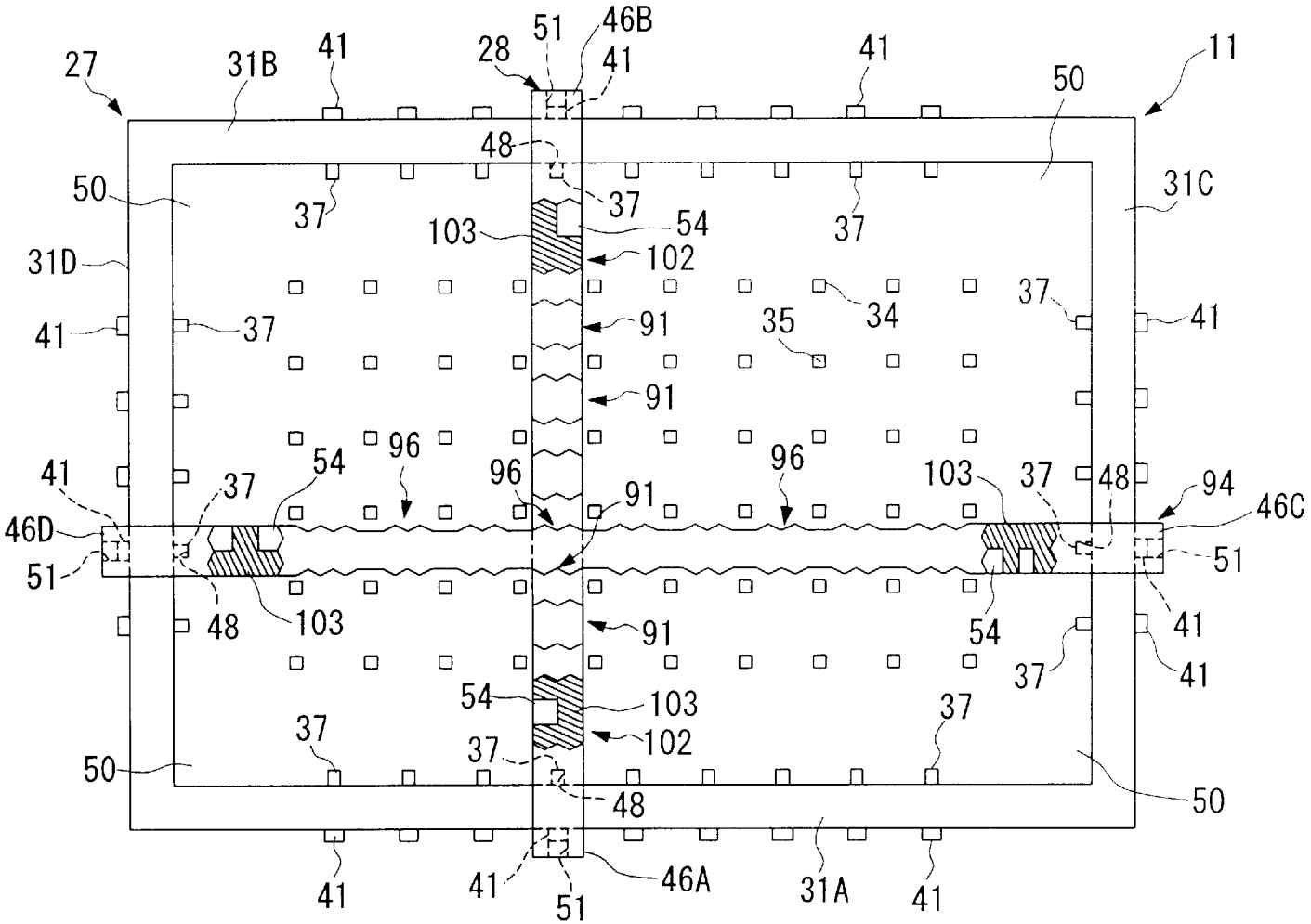
FIG. 23 is a plan view showing another form of an eighth embodiment of the general purpose connector according to the present invention.
Figure 24A:
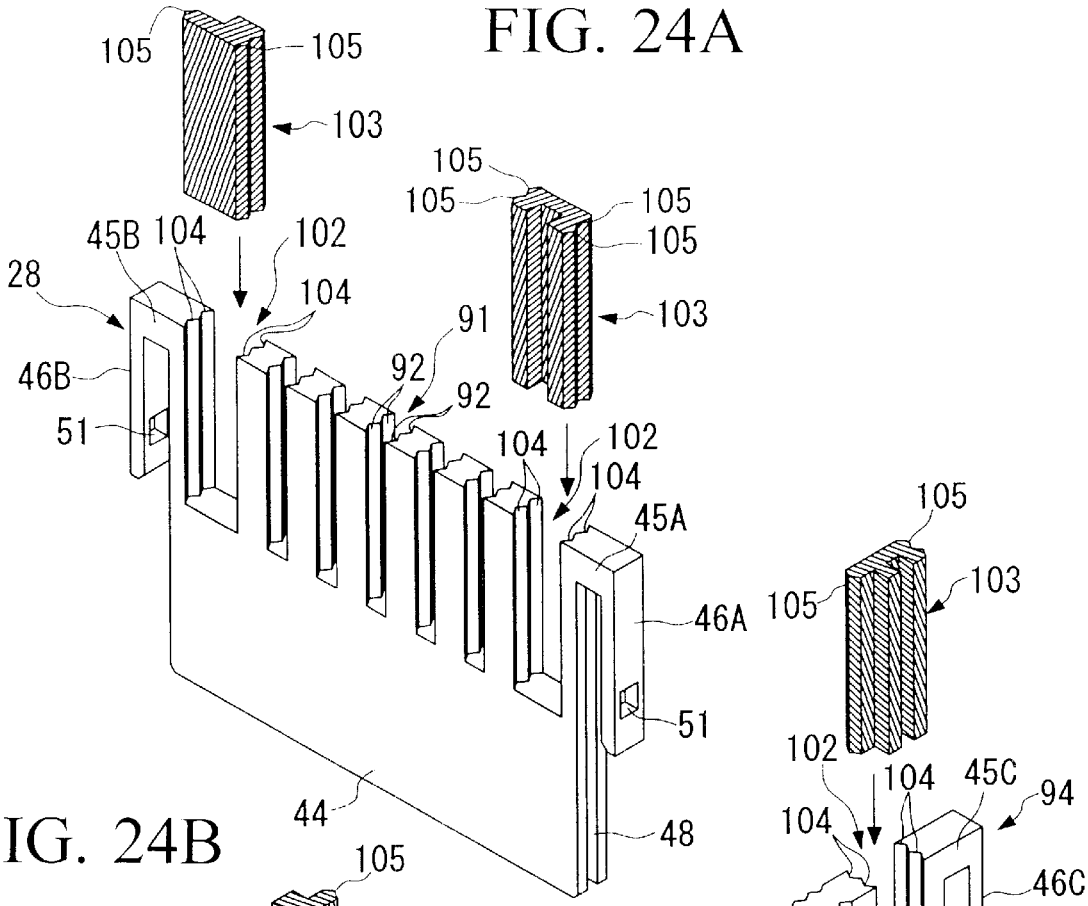
FIG. 24A is a perspective view showing another form of a partition of the eighth embodiment of the general purpose connector according to the present invention.
Figure 24B:
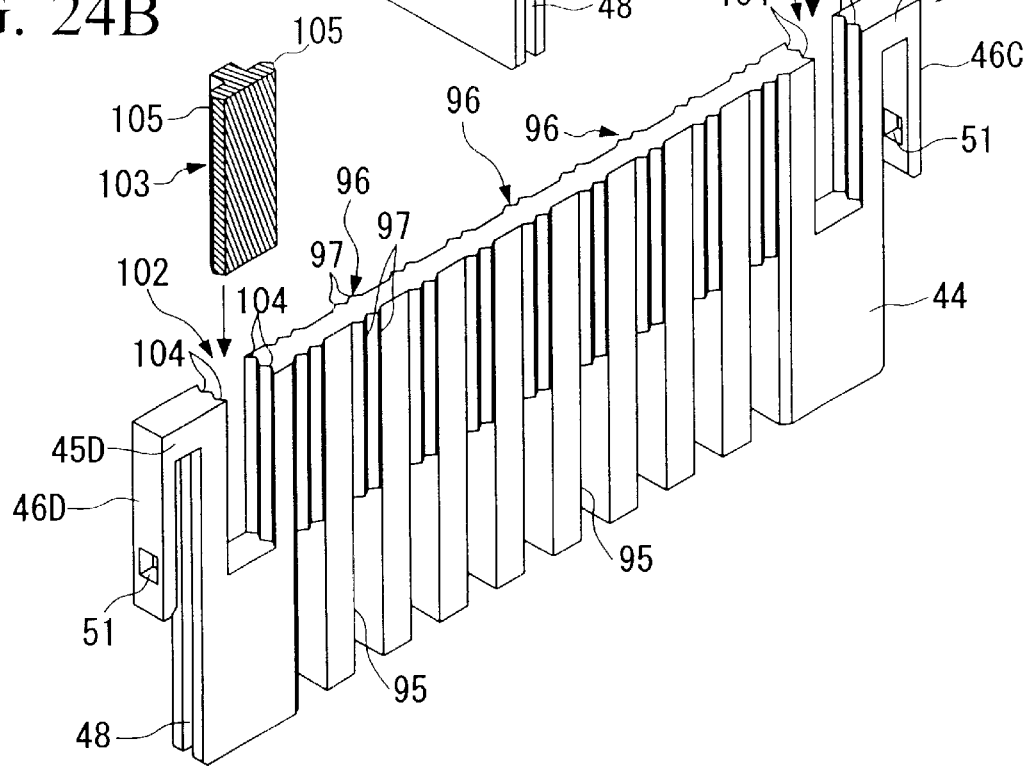
FIG. 24B is a perspective view showing another form of a cross partition of the eighth embodiment of the general purpose connector according to the present invention.

The partition 28 described above has a plurality of the cross positioning guide grooves 91, for engaging the cross partition 94, some of which are used for engagement of the mis-insertion prevention keys 99 in order to form the mis-insertion prevention guide grooves 54 in the receiving spaces 50, however, the partition 28 may have key grooves 102 exclusively made for forming the mis-insertion prevention guide grooves 54, as shown in FIGS. 23, 24A and 24B. The partition 28 shown in FIGS. 23, 24A and 24B, has key grooves 102 disposed outside the cross positioning guide grooves 91. The key groove 102 is formed by arranging two pairs of opposing engaging grooves 104, side by side, in the thickness direction of the partition 28, as the cross positioning guide groove 91. In the embodiment shown in FIGS. 23, 24A and 24B, the cross partition 94 also has key grooves 102 disposed outside the cross positioning guide engagements 96. In this embodiment, each receiving space 50 has a different mis-insertion prevention guide groove 54 formed by inserting mis-insertion prevention keys 103 each of which has a different shape from the others. The mis-insertion prevention key 103 has at least a pair of engaging projections 105 which engage at least a pair of the engaging grooves 104 out of the two pairs forming the key groove 102.

Figure 25:
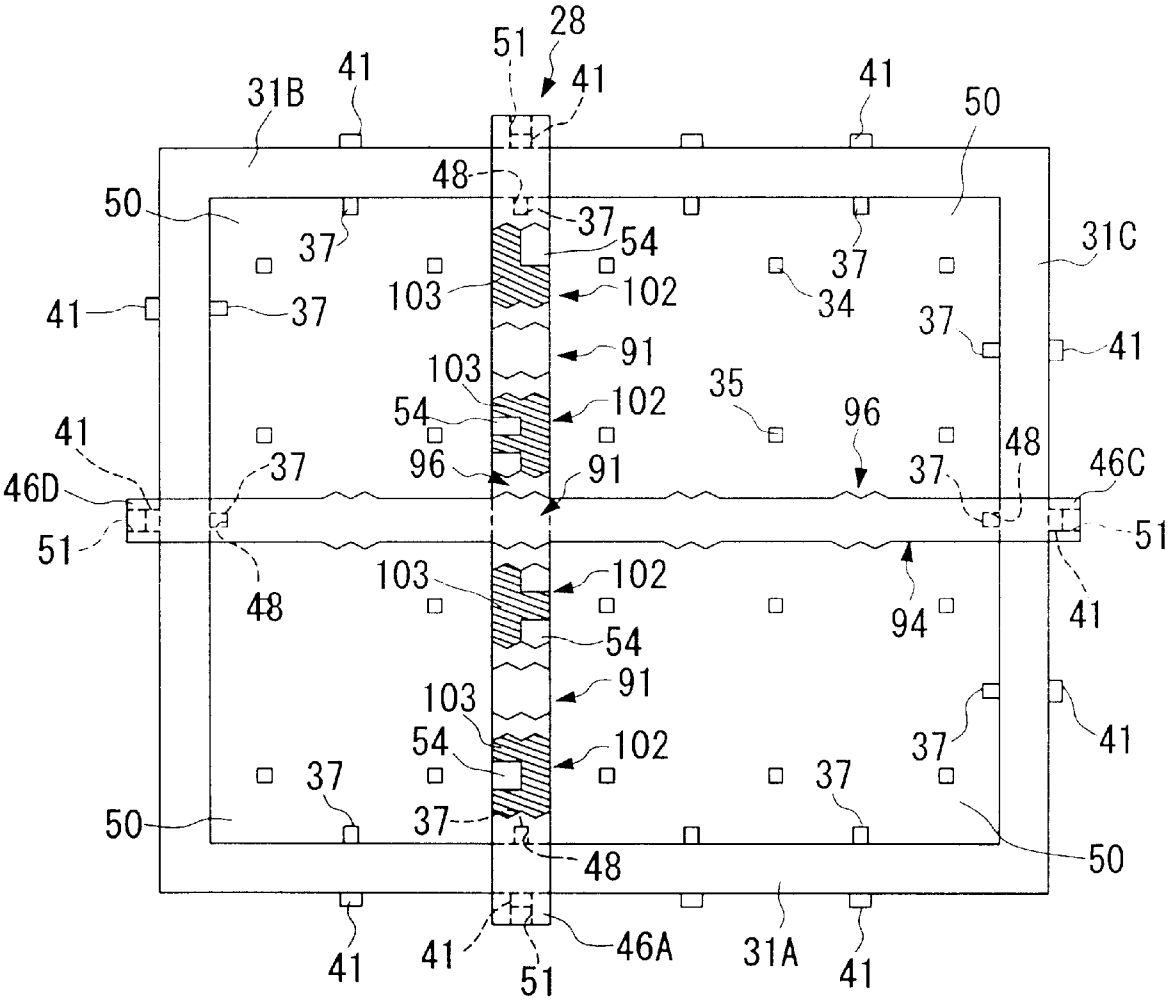
FIG. 25 is a plan view showing a further form of an eighth embodiment of the general purpose connector according to the present invention.
Figure 26A:
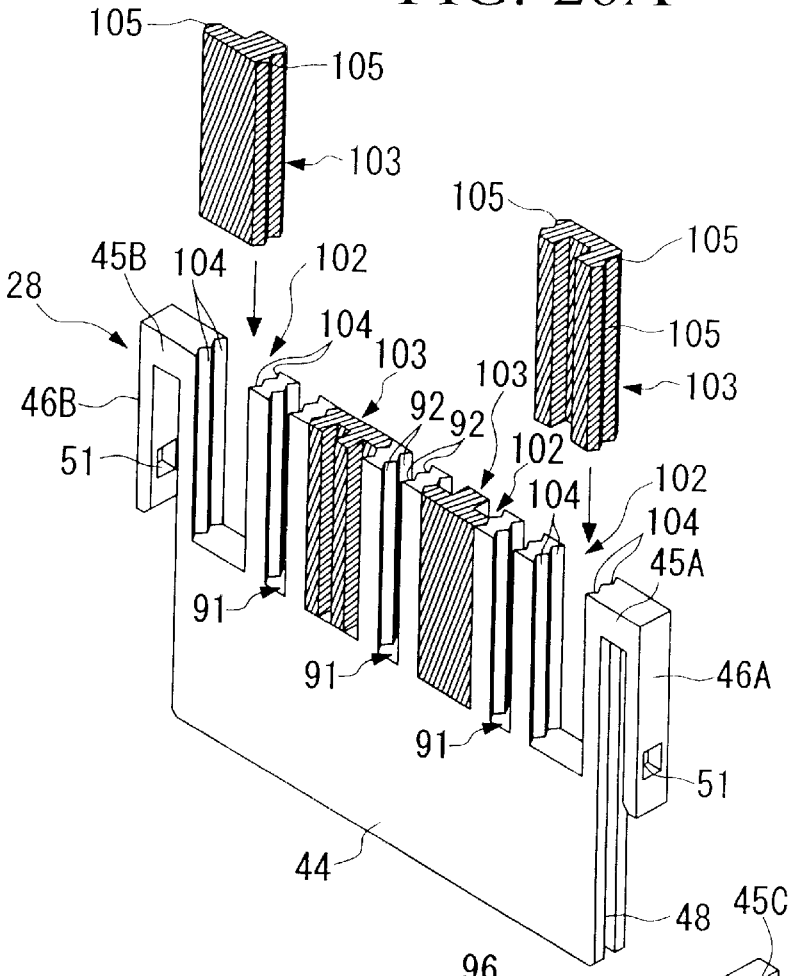
FIG. 26A is a perspective view showing a further form of a partition of the eighth embodiment of the general purpose connector according to the present invention.
Figure 26B:
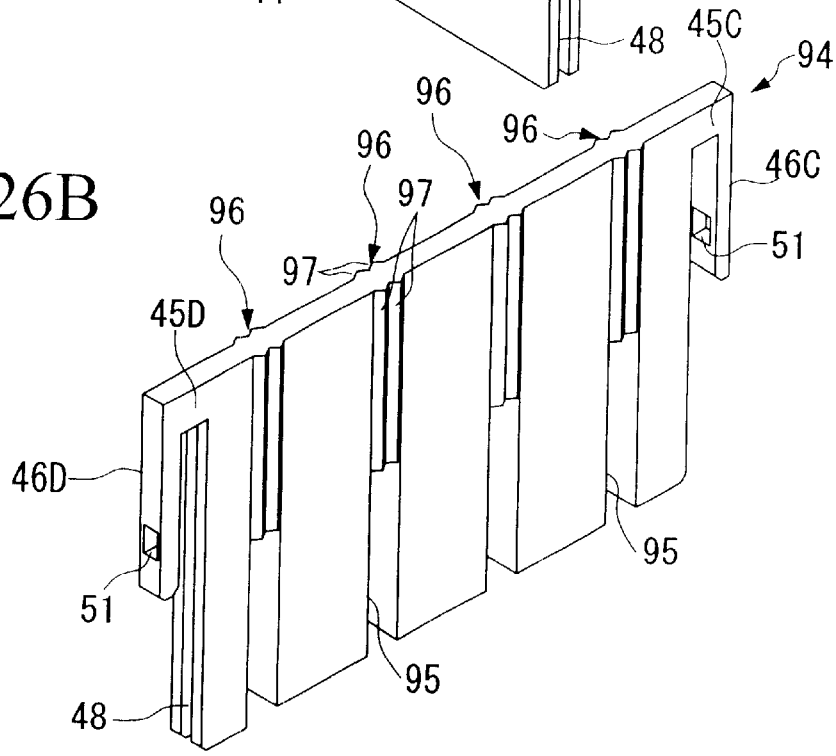
FIG. 26B is a perspective view showing a further form of a cross partition of the eighth embodiment of the general purpose connector according to the present invention.

As shown in FIGS. 25, 26A and 26B, the partition 28 may have the cross positioning guide grooves 91 and the key grooves 102 alternately. In this embodiment, each receiving space 50 has different mis-insertion prevention guide grooves 54 formed by inserting mis-insertion prevention keys 103 each of which has a different shape from the others, as in the previous embodiment.

In the first embodiment through the eighth embodiment, each engagement formed by a projection and a groove can be changed by alternating the projection and the groove. Some of the embodiments from the first through the eighth can be combined.

As explained in detail to this point, in the general purpose connector according to claim 1 of the present invention, as a result of inserting the partition into the connector housing, the connector housing and the partition form a receiving space for receiving a mating connector, and being suitable for the terminal arrangement of the mating connector. Therefore, it is possible to provide a plurality of terminal arrangements each of which is suitable for a designated mating connector having a specific terminal arrangement simply by inserting the partitions in appropriate positions while using the same connector housing. As a result, development costs can be reduced and inventory can be easily controlled even when a plurality of terminal arrangements are required. In addition, it is easy to cope with the mating connectors temporarily modified for the purpose of maintenance of or prototype stage for an apparatus having those connectors.

Furthermore, due to the mis-insertion prevention means, either incorrect insertion as a result of receiving the wrong mating connector having the same terminal arrangement or reversed insertion as a result of receiving a corresponding mating connector in a reversed orientation can be prevented. The same connector housings can be used in a variety of applications since the mis-insertion prevention means are formed on the partitions. Thus, the prevention of mis-insertion is ensured. Development costs can be kept relatively low even with the addition of the mis-insertion prevention function, and it is possible to avoid complicated inventory control.

In the general purpose connector according to claim 2 of the present invention, by inserting the partitions into the connector housing while being guided by the corresponding positioning guide means which are formed at a constant pitch in the walls of the connector housing, the partitions and the connector housing form the receiving space, for receiving a mating connector, which is suitable for the terminal arrangement of the mating connector. It is possible to easily and accurately define the mounting position of the partitions relative to the connector housing.

In the general purpose connector according to claim 3 of the present invention, the partitions can be inserted into the connector housing in a stable manner since the positioning guide means are formed in the walls of the connector housing continuous from a position opposite to the base to the position of the base. As a result, workability during insertion of the partitions into the connector housing is improved, and shifting in the position of the partitions relative to the connector housing can be prevented reliably.

In the general purpose connector according to claim 4 of the present invention, interference between the partitions and the terminals can be avoided since the positioning guide means are located at an intermediate position between the two adjacent terminal mounting portions.

In the general purpose connector according to claim 5 of the present invention, the cross partitions, the partitions and the connector housing thus form receiving space segments by fitting the cross partitions perpendicular to the partitions. The receiving space segments are arranged in both row and column directions. Therefore, it is possible to cope with a situation in which a plurality of terminal arrangements are required in both the row and the column directions.

In the general purpose connector according to claim 6 of the present invention, it is possible to easily and accurately define the mounting position of the partition and the cross partition since the partition and the cross partition have cross positioning guide means with which mutual positioning of the partition and the cross partition can be changed by regular intervals.

In the general purpose connector according to claim 7 of the present invention, deformation of the walls of the connector housing can be prevented since the partition has a pair of arms which respectively make contact with the outer surfaces of a pair of the walls of the connector housing. Detachment of the partitions from the connector housing can be prevented since the partition locking means formed on the arms and on the walls of the connector housing lock the partitions to the connector housing. In addition, it is easy to release the locking since the partition locking means are formed on the arms and on the walls of the connector housing e.g. outside of the connector housing. In this way, deformation of the connector housing is prevented, the mounting of the partitions in the connector housing is ensured and also workability of releasing the locking is improved.

In the general purpose connector according to claim 8 of the present invention, due to the partition-reversed insertion prevention means, the insertion of the partitions reversed from their correct orientation is prevented. As a result, the mounting of the partitions in the connector housing in the proper orientation is ensured.

In the general purpose connector according to claim 9 of the present invention, the connector locking means lock the mating connector which is inserted into the receiving space, thus prevent detachment of the mating connector. The connector housing is not enlarged in a direction in which the walls are arranged because the connector locking means are formed not on the connector housing but on the partitions. The connection of the mating connector is thus ensured and enlargement of the connector housing in a direction in which the walls are arranged is prevented. As a result, it is possible to install, at high density and with small pitch, a plurality of the connector housings, in the direction in which the walls of the connector housing are arranged.

In the general purpose connector according to claim 10 of the present invention, the partitions can also be supported by the pin shaped terminals as a result of inserting the terminals arranged in the terminal mounting portion into the holes formed on the partitions. Thus, the mounting of the partitions in the connector housing is ensured, and shifting in the position of the partitions relative to the connector housing can be prevented reliably. In addition, the partitions can be mounted even when the. terminal pitch is so small that partitions cannot be arranged in between the terminals.

In the general purpose connector according to claim 11 of the present invention, when mounting the partitions on the connecting housings arranged in series, the connecting means connect the connecting ends of the connector housings respectively. Thus, connection between the connector housings is ensured, and the walls are prevented from becoming weak due to having the connection area. In addition, since the partition also functions as a connecting member which connects the connector housings, the number of parts is limited compared with the case in which a separate member is used to connect the connector housings.

In the general purpose connector according to claim 12 of the present invention, undesired electromagnetic waves, which are emitted by transmission of high frequency signals through signal-transmission lines, can be blocked by the partitions and the shielding member, so that an excellent shielding effect is achieved.

Based on the method for connecting a general purpose connector according to the present invention, by means of inserting the partitions into the connector housing while being guided by the corresponding positioning guide means formed in the walls of the connector housing at a constant pitch, the receiving space is formed with the connector housing and the partitions for receiving a mating connector and are suitable for the terminal arrangement of the mating connector. Therefore, it is possible to provide a plurality of terminal arrangements each of which is suitable for a designated mating connector simply by inserting the partitions while being guided by the corresponding positioning guide means, even when a plurality of terminal arrangements are required to deal with different kinds of connectors. As a result, development costs can be reduced and inventory can be easily controlled even when a plurality of terminal arrangements are required. In addition, it is easy to deal with mating terminals temporarily modified for the purpose of maintenance of or prototype stage for the apparatus having those connectors.

In addition, due to the mis-insertion prevention means, either incorrect insertion as a result of receiving the wrong mating connector having the same terminal arrangement or reversed insertion as a result of receiving a corresponding mating connector in a reversed orientation can be prevented, thus the same connector housings can be used in a variety of applications. Therefore, development costs can be kept relatively low even with the addition of the mis-insertion prevention means, and it is possible to avoid complicated inventory control.

What is claimed is:

1. A general purpose connector, comprising:

a connector housing having a base including a terminal mounting portion and having at least a pair of walls formed on said base;

a plurality of separate and adjustable partitions being inserted into said connector housing and thus forming receiving spaces, together with said connector housing for receiving mating connectors of different sizes, being suitable for the terminal arrangement of each mating connector; and a first groove and a second groove formed on a main surface of each of said plurality of separate and adjustable partitions to prevent any of incorrect insertion as a result of receiving a wrong mating connector having the same terminal arrangement and reversed insertion as a result of receiving a corresponding mating connector in a reversed orientation.

2. The general purpose connector of claim 1, wherein:

said partitions have a pair of arms which respectively make contact with the outer surfaces of a pair of said walls of said connector housing, and wherein partition locking means are formed on said arms and on the walls of said connector housing in order to lock said partitions to said connector housing.

3. The general purpose connector of claim 1, wherein:

said partitions and said connector housing has partition-reversed insertion prevention means which prevent said partitions from being inserted into said connector housing in a reversed orientation.

4. The general purpose connector of claim 1, wherein:

said partitions have connector locking means which lock the mating connector being inserted into said receiving space to said partition.

5. The general purpose connector of claim 1, wherein:

terminals located in the terminal mounting portion are formed in a pin shape, and said partitions have holes receiving said terminals.

6. The general purpose connector of claim 1, wherein:

said connector housings can be connected to one another, and said partitions and said connector housings have connecting means which connect the ends of said connector housings.

7. The general purpose connector of claim 1, wherein:

said partitions are made of metal, and a shielding member made of metal is provided inside said connector housing.

8. The general purpose connector of claim 1, wherein the receiving spaces comprise a space bounded by at least one partition, the connector housing base, and the pair of walls formed on said base.

9. The general purpose connector of claim 1, wherein a size associated with each of the receiving spaces is determined based on the positioning of the plurality of the partitions.

10. The general purpose connector of claim 1, wherein the partitions are configured such that a size associated with each of the receiving spaces is adjustable based on the positioning of the partitions.

11. The general purpose connector of claim 1, wherein the general purpose connector is configured to receive a female connector in each of the receiving spaces, each of said receiving spaces comprising a space bounded by at least one partition, the connector housing base, and the pair of walls formed on said base.

12. A general purpose connector of claim 1, further comprising a third groove on a partition opposed to said partition with said first groove and said second groove.

13. A general purpose connector of claim 1, wherein said partition is inserted substantially perpendicular to said at least a pair of walls formed on said base of connector housing.

14. The general purpose connector of claim 1, wherein:

a plurality of positioning guide means are formed at a constant pitch in said walls of said connector housing, and wherein said partitions are inserted into said connector housing while being guided by the corresponding positioning guide means.

15. The general purpose connector of claim 14, wherein:

said positioning guide means are formed in said walls continuous from a position opposite to the base to the position of the base.

16. The general purpose connector of claim 14, wherein:

said positioning guide means are located at an intermediate position between the two adjacent terminal mounting portions.

17. The general purpose connector of the claim 1, further comprising:

cross partitions being fitted perpendicular to said partitions and thus forming receiving space segments together with said connector housing.

18. The general purpose connector of claim 17, wherein:

said partitions and said cross partitions have cross positioning guide means with which the mutual positioning of said partitions and said cross partitions can be changed by regular intervals.

19. A method for connecting a general purpose connector, comprising:

providing a connector housing having a base having at least a pair of walls formed on said base, wherein a plurality of position guide means are formed at a constant pitch on said walls of said connector housing;

inserting separate and adjustable partitions into said connector housing while being guided by the corresponding positioning guide means, and thereby forming receiving spaces, together with said connector housing for receiving mating connectors of different sizes, said receiving spaces are suitable for the terminal arrangement of a designated mating connector; and using said separate and adjustable partitions having a main surface formed with a first groove and a second groove to prevent any of incorrect insertion as a result of receiving the wrong mating connector having the same terminal arrangement and reversed insertion as a result of receiving a corresponding mating connector in a reversed orientation, by the particular shape of said separate and adjustable partition.

20. The method of claim 19, further comprising receiving a female connector in the receiving space, said receiving space comprising a space bounded by at least one partition, the connector housing base, and the pair of walls formed on said base.

21. The method of claim 19, further comprising moving one of the partitions from a first position to a second position to adjust the size of at least one receiving space.

22. A general purpose connector, comprising:

a connector housing having a base including a terminal mounting portion and having at least a pair of walls formed on said base; and a plurality of separate and adjustable partitions being inserted into said connector housing and thus forming receiving spaces, together with said connector housing for receiving mating connectors of different sizes, being suitable for the terminal arrangement of each mating connector, wherein a first groove and a second groove are formed into a main surface of each said plurality of separate and adjustable partitions to prevent any of incorrect insertion resulting from any of receiving the wrong mating connector having the same terminal arrangement and reversed insertion as a result of receiving a corresponding mating connector in a reversed orientation.

23. A general purpose connector, comprising:

a connector housing having a base including a terminal mounting portion, and having at least a pair of walls formed on said base; and at least one separate and adjustable partition inserted into said connector housing to form a modular receiving space, together with said connector housing for receiving a mating connector of at least one configuration and size, being suitable for the terminal arrangement of each mating connector, said at least one separate and adjustable partition has a main surface formed with a first groove and a second groove to prevent either incorrect insertion as a result of receiving a wrong mating connector having the same terminal arrangement or reversed insertion as a result of receiving a corresponding mating connector in a reversed orientation.

24. A general purpose connector of claim 23, further comprising a mis-insertion prevention projection opposed to said mis-insertion prevention groove.

* * * * *